US011491505B2

(12) United States Patent
Furuhashi et al.

(10) Patent No.: US 11,491,505 B2
(45) Date of Patent: Nov. 8, 2022

(54) APPLICATION TOOL

(71) Applicant: Sunstar Engineering Inc., Takatsuki (JP)

(72) Inventors: Kazuki Furuhashi, Takatsuki (JP); Hirokazu Okamoto, Takatsuki (JP)

(73) Assignee: SUNSTAR ENGINEERING INC., Takatsuki (JP)

( * ) Notice: Subject to any disclaimer, the term of this patent is extended or adjusted under 35 U.S.C. 154(b) by 0 days.

(21) Appl. No.: 17/266,352

(22) PCT Filed: Aug. 7, 2019

(86) PCT No.: PCT/JP2019/031184

§ 371 (c)(1),
(2) Date: Feb. 5, 2021

(87) PCT Pub. No.: WO2020/032126

PCT Pub. Date: Feb. 13, 2020

(65) Prior Publication Data

US 2021/0316327 A1 Oct. 14, 2021

(30) Foreign Application Priority Data

Aug. 8, 2018 (JP) ..... JP2018-149079

(51) Int. Cl.
*B05C 1/02* (2006.01)
*B05C 17/00* (2006.01)
(Continued)

(52) U.S. Cl.
CPC ..... *B05C 1/02* (2013.01); *B05C 17/00* (2013.01); *B05C 17/12* (2013.01); *B05D 1/28* (2013.01); *E04F 21/02* (2013.01)

(58) Field of Classification Search
CPC ..... B05C 5/02; B05D 1/28
See application file for complete search history.

(56) References Cited

U.S. PATENT DOCUMENTS 4,569,305 A * 2/1986 Ferri ..... H05K 13/0469 118/211
4,704,305 A 11/1987 Berger et al.
(Continued)

FOREIGN PATENT DOCUMENTS

CN 205443872 U 8/2016
JP S60-223193 A 11/1985
(Continued)

OTHER PUBLICATIONS

International Search Report for International Application No. PCT/JP2019/031184 dated Oct. 29, 2019 (3 sheets, 2 sheets translation, 5 sheets total).

*Primary Examiner* — Dah-Wei D. Yuan
*Assistant Examiner* — Stephen A Kitt
(74) *Attorney, Agent, or Firm* — Kratz, Quintos & Hanson, LLP

(57) ABSTRACT

Provided is an application tool that allows reduction of an amount of waste by using no masking sheets, and can easily form a coated portion such as an antislip protrusion with reduced variation in a short time period. The application tool includes a support plate and a plurality of application bodies disposed at the support plate so as to protrude with height positions of the tips aligned with each other. A tip recess is disposed at the tip portion of each of the plurality of the application bodies as a holding recess for holding coating liquid.

9 Claims, 15 Drawing Sheets

(51) Int. Cl.

| | |
|---|---|
| ***B05C 17/12*** | (2006.01) |
| ***B05D 1/28*** | (2006.01) |
| ***E04F 21/02*** | (2006.01) |

(56) References Cited

U.S. PATENT DOCUMENTS

| | | | | |
|---|---|---|---|---|
| 4,946,708 | A * | 8/1990 | Habich | B05C 1/16 118/200 |
| 2011/0132109 | A1* | 6/2011 | Delaage | B01L 3/0244 73/863.32 |
| 2018/0252512 | A1* | 9/2018 | Oh | G01B 11/0675 |

FOREIGN PATENT DOCUMENTS

| | | | |
|---|---|---|---|
| JP | H03-008246 | U | 1/1991 |
| JP | H03-72157 | A | 3/1991 |
| JP | H03-98669 | A | 4/1991 |
| JP | H04-091764 | U | 8/1992 |
| JP | H05-022061 | U | 3/1993 |
| JP | 2013-013865 | A | 1/2013 |
| JP | 2016-061040 | A | 4/2016 |
| WO | 2016/117455 | A1 | 7/2016 |

* cited by examiner

APPLICATION TOOL

TECHNICAL FIELD

The present invention relates to an application tool capable of simultaneously applying coating liquid to a plurality of portions.

BACKGROUND ART

In general, stone materials such as ceramic tiles, marble, and granite are widely used as flooring materials for buildings such as various commercial facilities, retail stores, medical facilities, accommodation facilities, public facilities, apartment houses, and individual houses, because the stone material is glossy and maintenance-free, and provides a luxurious appearance. However, these flooring materials have smooth surfaces and are thus slippery, and become more slippery particularly when water is adhered to floor surfaces or shoe soles, for example, in rainy weather or after cleaning. This reduces safety in walking. In order to enhance safety in walking, for example, the floor surface may be provided with antislip grooves. However, this may deteriorate aesthetic appearance and design of the floor surface.

In view of the above, an antislip structure in which transparent antislip protrusions each having a diameter of not greater than 10 mm are dispersed and fixed on the surface of the flooring material so as to protrude has been suggested. Furthermore, a method for forming the antislip protrusions is suggested. The method includes a masking step of adhering, to the floor surface, a masking sheet having a plurality of openings dispersed, an adhesive applying step of filling the openings with an adhesive, and a masking elimination step of eliminating the masking sheet after the adhesive has been dried (see Patent Literatures 1 and 2).

CITATION LIST

Patent Literature

[PTL 1] Japanese Unexamined Patent Application Publication No. 2016-61040

[PTL 2] Japanese Unexamined Utility Model Application Publication No. H03-008246

SUMMARY OF THE INVENTION

Problems to be Solved by the Invention

However, if the antislip protrusions are formed with the masking sheet as in the inventions disclosed in Patent Literatures 1 and 2, for example, the masking sheet is wasted after the antislip protrusions are formed, and setting of the masking sheet is a bothersome operation, so that the antislip protrusions cannot be easily formed in a short time period.

An object of the present invention is to provide an application tool that can reduce an amount of waste by using no masking sheets, and can easily form a coated portion such as an antislip protrusion with reduced variation in a short time period.

Solution to the Problems

The present invention is directed to an application tool described below.

(1) An application tool including: a support plate; and a plurality of application bodies disposed at the support plate so as to protrude, in which each of the plurality of application bodies has, at a tip portion thereof, a holding recess capable of holding coating liquid.

(2) In the application tool described in (1), a tip recess having an opening at a tip face of the application body is formed as the holding recess.

(3) In the application tool described in (2), a protrusion protruding outward of the opening of the tip recess is disposed at a bottom of the tip recess.

(4) In the application tool described in (2) or (3), each of the plurality of application bodies includes a support rod disposed at the support plate so as to protrude, and an application tube disposed on an outer side of a tip portion of the support rod, and the tip recess is formed in a tip portion of the application tube.

(5) In the application tool described in (4), the tip portion of the support rod has a protrusion formed as an acuminated portion that protrudes outward of the opening of the tip recess.

(6) In the application tool described in any one of (1) to (5), an annular or a helical outer circumferential groove portion having an opening at an outer circumferential surface of the tip portion of the application body is disposed as the holding recess.

(7) In the application tool described in any one of (1) to (6), the support plate has a flat-plate shape.

(8) In the application tool described in any one of (1) to (7), the plurality of application bodies are disposed at the support plate so as to be movable in an up-down direction, and a first urging member for constantly urging each of the plurality of application bodies toward lower limit positions is disposed in each of the application bodies.

(9) In the application tool described in any one of (1) to (8), a guide member is disposed at the support plate so that a lower end portion of the guide member is movable in the up-down direction between an upper position above a lower end portion of the application body and a lower position below the lower end portion of the application body, and a second urging member for constantly urging the guide member toward the lower position is provided.

(10) In the application tool described in (9), the guide member has a guide plate, disposed parallel to the support plate, for guiding a mid-portion of each of the plurality of application bodies so that the mid-portion of the application body is movable in a length direction of the application body.

(11) In the application tool described in any one of (1) to (10), the coating liquid contains an antislip treatment composition.

Advantageous Effects of the Invention

According to the application tool of the present invention, an amount of waste by using no masking sheets, and can easily form a coated portion such as an antislip protrusion with reduced variation in a short time period.

DESCRIPTION OF EMBODIMENTS

Embodiments of the present invention will be described below with reference to the drawings.

Figure 1:
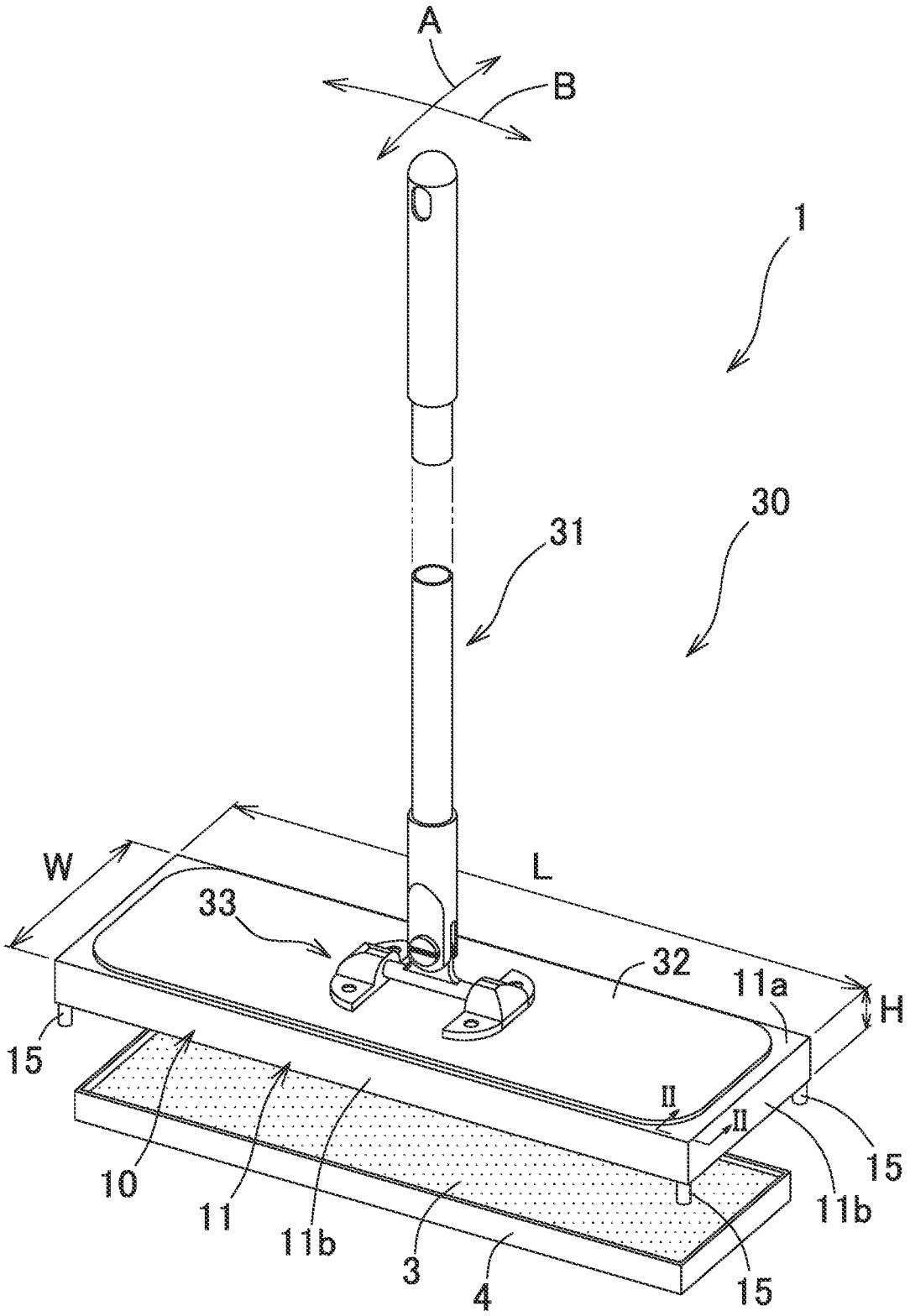
FIG. 1 is a perspective view of an application tool and a coating liquid tray.
Figure 7A:
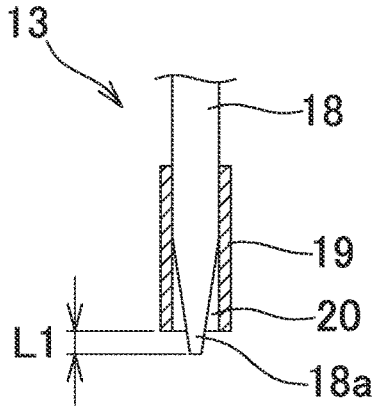
FIG. 7A is an enlarged longitudinal cross-sectional view of a tip portion of an application body.
Figure 7B:
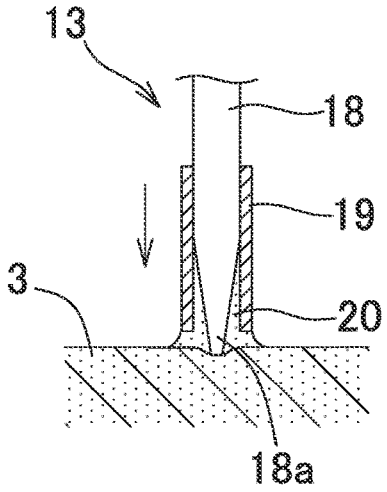
FIG. 7B illustrates the tip portion of the application body and a liquid absorber in the case of the tip portion of the application body being brought into contact with the liquid absorber.
Figure 7C:
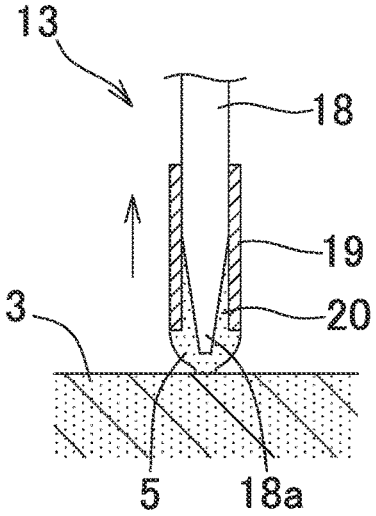
FIG. 7C illustrates the tip portion of the application body and the liquid absorber immediately before the tip portion of the application body is separated from the liquid absorber.
Figure 7D:
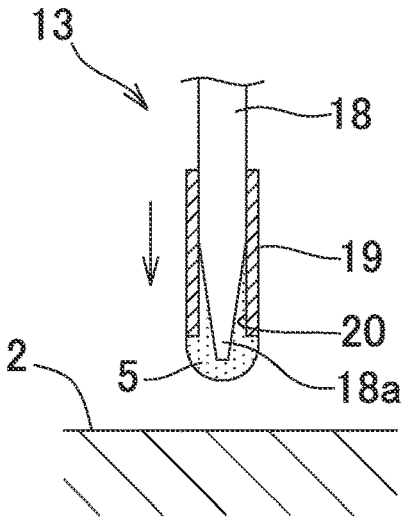
FIG. 7D illustrates the tip portion of the application body and a to-be-coated surface immediately before coating liquid is applied to the to-be-coated surface.
Figure 7E:
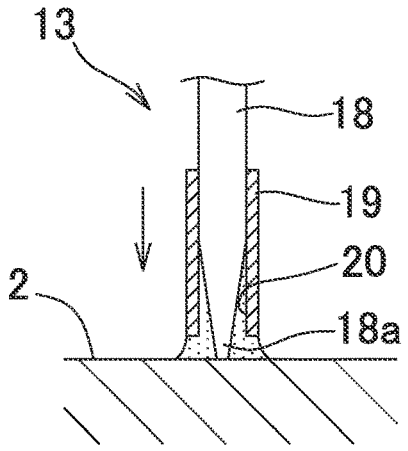
FIG. 7E illustrates the tip portion of the application body and the coating liquid applied to the to-be-coated surface in the case of the tip portion of the application body being in contact with the to-be-coated surface.
Figure 7F:
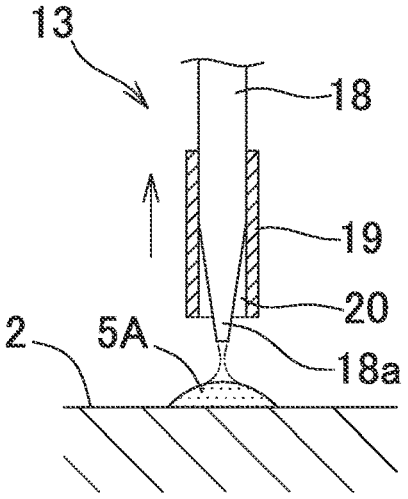
FIG. 7F illustrates the tip portion of the application body and a coated portion formed on the to-be-coated surface in the case of the tip portion of the application body being separated from the to-be-coated surface.
Figure 7G:
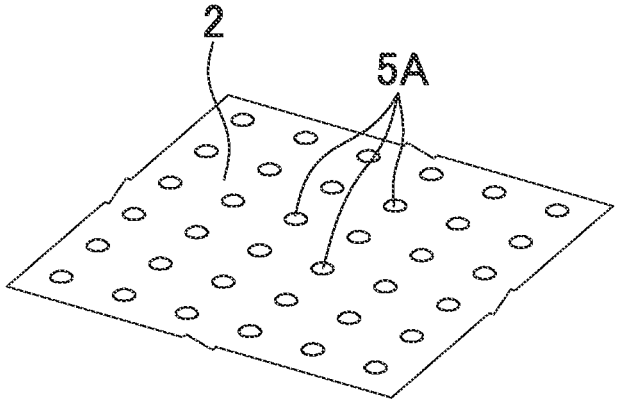
FIG. 7G illustrates the coated portions formed on the to-be-coated surface.

As shown in FIG. 1 and FIG. 7G, an application tool 1 includes an application tool body 10 for applying coating liquid as dots to a to-be-coated surface 2 such as a floor surface in a building, so as to form coated portions 5A, and an operation portion 30 for operating the application tool body 10.

Figure 4:
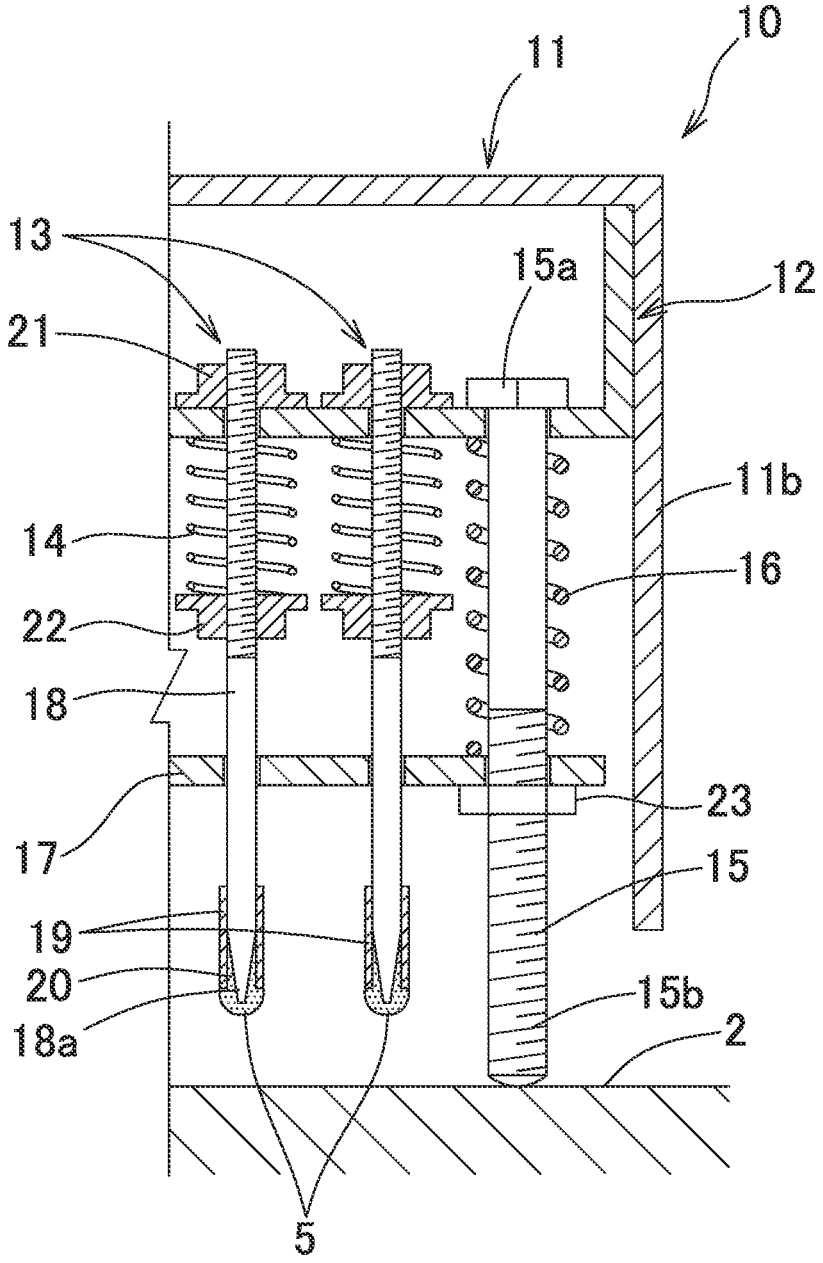
FIG. 4 illustrates a state immediately before coating liquid is applied to a to-be-coated surface.

The coating liquid is impregnated into a liquid absorber 3 such as a sponge or a nonwoven fabric, and is stored in an application tray 4. The tip portion of an application body 13, which will be described below, disposed in the application tool body 10 is pressed against the liquid absorber 3, whereby a unit coating liquid 5 in an amount required for one application is adhered to the tip portion of the application body 13 without excess or deficiency, as shown in FIG. 4. Therefore, liquid dripping caused by excessive adhesion can be prevented. A required amount of the coating liquid may be applied to the to-be-coated surface 2 in one application, or a required amount of the coating liquid may be applied to the to-be-coated surface 2 by applying the coating liquid to the same portion multiple times.

As the coating liquid, a liquid having any composition, such as an antislip treatment composition or an oil-based or water-based coating material, can be applied to the to-be-coated surface 2. For example, as shown in FIG. 7G, a coating liquid having an antislip treatment composition is applied as dots to the to-be-coated surface 2 including a floor surface in a building, in the line direction and the column direction at intervals, whereby the coated portions 5A can be formed as antislip protrusions. The shape and the size of each coated portion 5A, arrangement of positions of a plurality of the coated portions 5A, and the like can be optionally set according to usage of the coated portions 5A, or the like. For example, intervals between the coated portions 5A in the line direction and intervals therebetween in the column direction can be set to be the same or different from each other. In a case where a dome-shaped antislip protrusion having a diameter of 1 mm or more and 50 mm or less is formed as the coated portion 5A on the to-be-coated surface 2 that is a floor surface in a building, each of the interval between the coated portions 5A adjacent to each other in the line direction and the interval therebetween in the column direction is preferably set to be, for example, 1 mm to 10 mm.

The operation portion 30 has a known structure that includes an operation rod 31, a base plate 32, and a connecting portion 33 that connects the operation rod 31 to the base plate 32 such that the operation rod 31 can oscillate in the direction indicated by an arrow A and the direction indicated by an arrow B, as shown in FIG. 1.

Here, the connecting portion 33 can have a known structure other than the structure shown in FIG. 1 as long as the base plate 32 can be connected to the tip portion of the operation rod 31 in an oscillatable manner. In addition, the tip portion of the operation rod 31 may be fixed to the center portion of the base plate 32 in an unoscillatable manner, without providing the connection portion 33. In a relatively small application tool, instead of the operation rod 31 and the connecting portion 33, a handle portion may be attached to the base plate 32, and the application tool body 10 may be operated in a state where the handle portion is held by a hand. Furthermore, the base plate 32 may be omitted, and the operation rod 31 may be connected directly or indirectly through the connecting portion 33 to the center portion of an upper wall portion 11*a* of a casing 11 of the application tool body 10, or a handle portion which can be operated by a hand may be disposed directly on the center portion of the upper wall portion 11*a*, instead of the connecting portion 33 and the operation rod 31.

Figure 2:
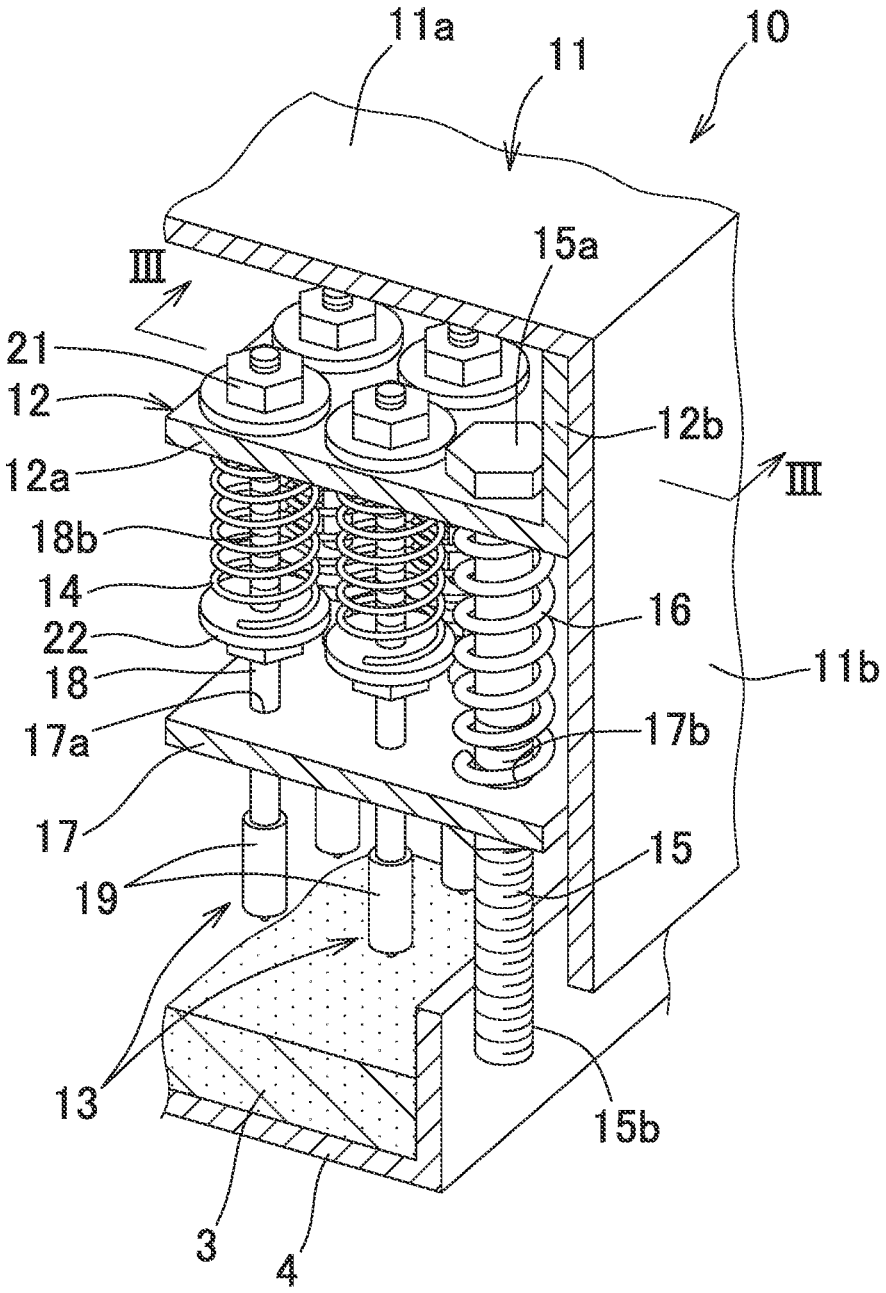
FIG. 2 is a perspective view of a cross section taken along a line II-II in FIG. 1.
Figure 3:
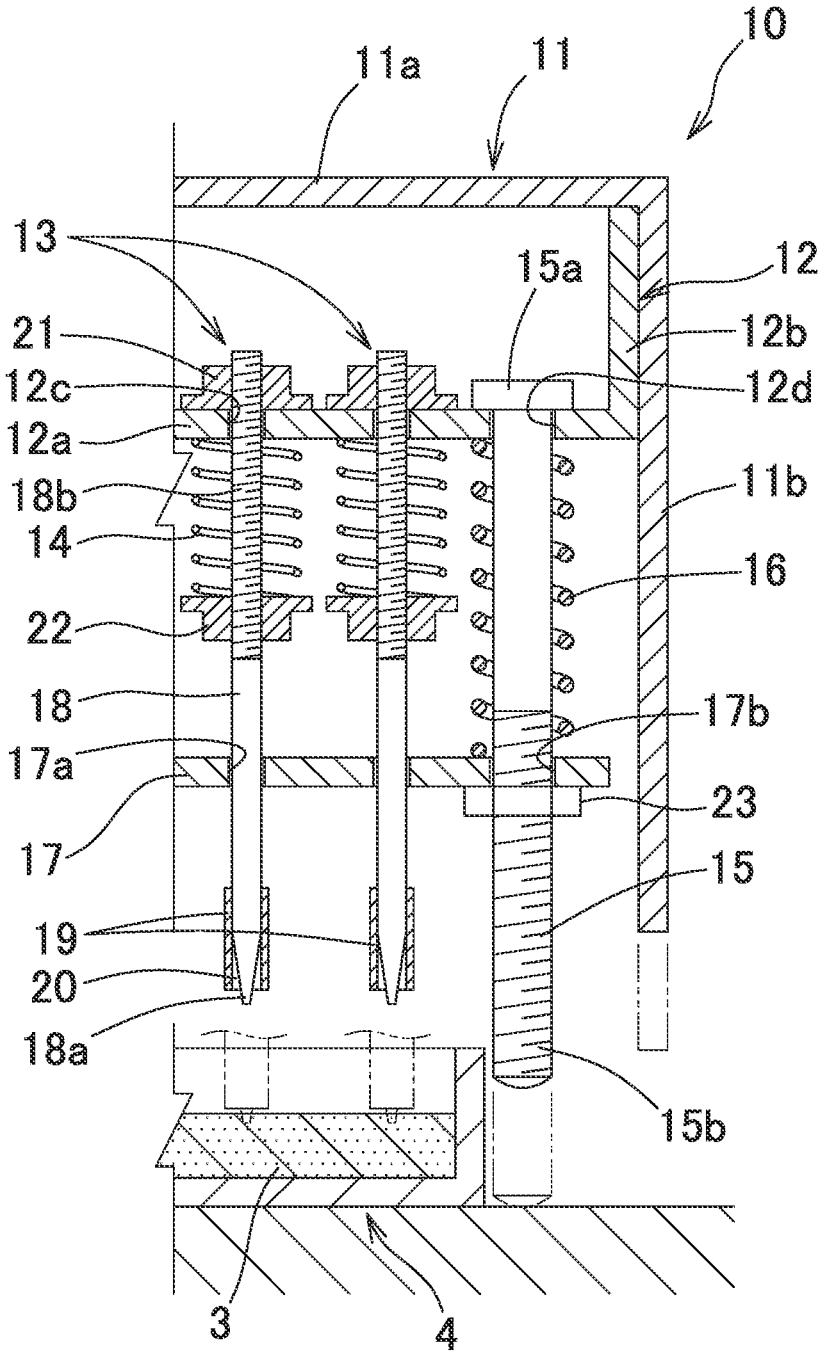
FIG. 3 is a cross-sectional view taken along a line III-III in FIG. 2.

The application tool body 10 includes the casing 11, a support plate 12, a plurality of rod-shaped application bodies 13, first urging members 14, a plurality of guide rods 15 (corresponding to a guide member), second urging members 16, and a guide plate 17, as shown in FIG. 1 to FIG. 3. The casing 11 is rectangular-parallelepiped-shaped and is opened on the lower face side thereof. The support plate 12 is fixed in the upper portion of the casing 11 so as to be almost parallel to the upper wall portion 11*a* of the casing 11. The plurality of application bodies 13 are inserted in the support plate 12 so as to be movable in the up-down direction. The first urging members 14 constantly urge the plurality of application bodies 13 separately to the lower limit positions indicated by solid lines, respectively, in FIG. 3. The plurality of guide rods 15 are inserted in the support plate 12 so as to be movable in the up-down direction. The second urging members 16 constantly urge the plurality of guide rods 15 separately downward. The guide plate 17 is held at mid-portions, in the length direction, of the plurality of guide rods 15 so as to be almost parallel to the support plate 12 so that mid-portions of the plurality of application bodies 13 are inserted.

The casing 11 has the rectangular-plate-shaped upper wall portion 11*a*, and a rectangular-frame-shaped side wall portion 11*b* extending downward from the outer edge of the upper wall portion 11*a*. The casing 11 is formed of a metal material such as iron or an aluminium alloy or a synthetic resin material, is rectangular-parallelepiped shaped, and is opened on the lower face side. The base plate 32 is fixed at the center portion of the upper face of the upper wall portion 11*a* of the casing 11, and the casing 11 is rotatably connected to the lower end portion of the operation rod 31 through the connecting portion 33. A length L of the casing 11 in the left-right direction and a width W thereof in the front-rear direction can be optionally set in consideration of the size of the to-be-coated surface 2 and operability by a hand of a person. For example, the casing 11 having the length L of 50 mm to 1000 mm and the width W of 50 mm to 10×) mm can be used. A height H of the casing 11 can be optionally set. However, the height H is preferably about 10 mm to 200 mm. In a case where the to-be-coated surface 2 is formed of a stone material such as ceramic tiles, marble, or granite, the length and the width of the support plate 12 can be each set to a dimension corresponding to the surface of the stone material or a (one/integer) dimension of the surface of the stone material such that the unit coating liquid 5 corresponding to the required number of the to-be-coated surfaces 2 in one stone material can be applied in one application or multiple times of application. For example, in a case where the size of the surface of the stone material is 600 mm×600 mm, the length of the support plate 12 can be set to, for example, 600 mm, 300 mm, 200 mm, or 100 mm, or the width of the support plate 12 can be set to, for example, 600 mm, 300 mm, 200 mm, 100 mm, or 50 mm.

The support plate 12 is rectangular-tray-shaped, and includes a flat plate portion 12*a* that is rectangular-plate-shaped, and a mounting portion 12*b* that extends upward from the outer peripheral edge of the flat plate portion 12*a* and is fixed to the inner face of the side wall portion 11*b* of the casing 11. The guide plate 17 is formed in a rectangular plate shape having a planar dimension that is slightly smaller than the flat plate portion 12*a* of the support plate 12 so as to be disposed in the casing 11. The support plate 12 and the guide plate 17 are each formed of a metal material such as iron or an aluminium alloy or a synthetic resin material, similarly to the casing 11. The support plate 12 may be flat-plate-shaped without having the mounting portion 12*b*.

The flat plate portion 12*a* of the support plate 12 has upper through holes 12*c* through which the application bodies 13 are inserted. The upper through holes 12*c* are formed at intervals in each of the line direction and the column direction so as to correspond to positions at which the unit coating liquid 5 is applied to the to-be-coated surface 2. Upper guide holes 12*d* through which the guide rods 15 are inserted are formed at the four corners of the support plate 12 outside a region in which the plurality of the upper through holes 12*c* are formed. The guide rods 15 can be disposed at any positions of the support plate 12 except for the positions corresponding to positions at which the unit coating liquid 5 is applied. The number of the guide rods 15 may be any number that is not less than three so as to stably place the application tool body 10 relative to the to-be-coated surface 2.

The guide plate 17 has lower through holes 17*a* through which the application bodies 13 are inserted, so as to correspond to the plurality of the upper through holes 12*c* formed in the support plate 12. The guide plate 17 also has lower guide holes 17*b* through which the guide rods 15 are inserted, so as to correspond to the plurality of the upper guide holes 12*d* formed in the support plate 12.

Each application body 13 includes a support rod 18 that is inserted through the upper through hole 12*c* of the support plate 12 and the lower through hole 17*a* of the guide plate 17 so as to be movable in the up-down direction, and an application tube 19 that is disposed on the outer side of the lower end portion (tip portion) of the support rod 18, as shown in FIG. 2, FIG. 3, and FIG. 7A.

The application tube 19 is formed as a cylindrical member formed of a flexible material such as elastomer. Here, the outer shape of the application tube 19 may not necessarily be a cylindrical shape, and may have any tubular shape such as a shape that forms a transverse cross-section having a polygonal shape such as an ellipsoidal, triangular, quadrangular, or a hexagonal shape, a star-like-shape, or heart-like-shape. The outer shape of at least the tip portion of the application tube 19 is formed in a desired shape, whereby the unit coating liquid 5 can be applied to the to-be-coated surface 2 into an outer shape corresponding to the shape of the tip portion of the application tube 19. The inner shape of the application tube 19 may be a tubular shape that forms a transverse cross-section having a circular shape, an ellipsoidal shape, or a polygonal shape such as a triangular, quadrangular, or hexagonal shape, or may be a pyramidal shape having a diameter increased toward the tip side. The inner shape of the application tube 19 may be analogous to the outer shape of the application tube, or may be different from the outer shape thereof.

The support rod 18 is formed as a rod-like member that is formed of a metal material or a synthetic resin material and that has a strength and stiffness resistant to pressing operation force during application. As shown in FIG. 7A, a protrusion 18*a* is disposed at the lower end portion of the support rod 18. The protrusion 18*a* includes an acuminated portion that protrudes toward the opening at the lower end of the application tube 19. The protrusion 18*a* can have any shape such as a cylindrical shape, a conical shape, a truncated-cone shape, an elliptic-cylinder shape, an elliptic-cone shape, a truncated elliptic-cone shape, a polygonal-prism shape, a polygonal-pyramid shape, or a truncated polygonal-pyramid shape. The tip of the protrusion 18*a* may be acuminated, may be formed as a flat surface, or may have a dome-like shape such as a semispherical shape.

As shown in FIG. 7A, although the lower end portion of the protrusion 18*a* may be disposed above the lower end portion of the application tube 19, the lower end portion of the protrusion 18*a* preferably protrudes slightly downward of the lower end portion of the application tube 19 without protruding downward of the unit coating liquid 5 adhered to the application body 13. The protruding length L1 of the protrusion 18*a* from the tip portion of the application tube 19 may be optionally set, and can be set to, for example, 0.01 mm to 10 mm and can be preferably set to 0.1 mm to 5 mm.

Thus, in a case where the protrusion 18*a* protrudes downward of the application tube 19, the protrusion 18*a* is inserted in the unit coating liquid 5 as shown in FIG. 7D. Therefore, an amount of the unit coating liquid 5 that is required for one application and held at the tip portion of the application body 13 can be made constant, and the unit coating liquid 5 can be held at the lower end portion of the application body 13 such that liquid does not drip due to, for example, vibration during movement of the application tool body 10. When the unit coating liquid 5 is applied to the to-be-coated surface 2, the protrusion 18*a* comes into contact with the to-be-coated surface 2, whereby a certain gap is formed between the application tube 19 and the to-be-coated surface 2, as shown in FIG. 7E. Therefore, the unit coating liquid 5 can be quickly applied to the to-be-coated surface 2 and the applied unit coating liquid 5 can be prevented from containing air. Even if air is contained, air foam between the application tube 19 and the to-be-coated surface 2 can be broken. Furthermore, when the protrusion 18*a* is removed from the applied unit coating liquid 5, the center portion of the unit coating liquid 5 is raised as indicated by an imaginary line in FIG. 7F, and, thereafter, the protrusion 18*a* is removed from the center portion and the upper face of the unit coating liquid 5 becomes flat. Therefore, the applied unit coating liquid 5 can be formed in a perfect dome shape.

A tip recess 20 is formed, between the protrusion 18*a* and the application tube 19, as a holding recess that forms a cylindrical space having such a shape as to correspond to the inner shape of the application tube 19 and the outer shape of the protrusion 18*a*. The width of the tip recess 20 in the radial direction can be constant from the upper end portion to the lower end portion. However, the width of the tip recess 20 is preferably narrowed toward the upper side so as to reduce the transverse area of the tip recess 20 toward the upper side. The tip recess 20 having such a structure allows the unit coating liquid 5 to be held in the tip recess 20 also through capillary phenomenon in the tip recess 20. Therefore, the unit coating liquid 5 can be held at the lower end portion of the application body 13 so that liquid does not drip due to, for example, vibration during operation of the application tool body 10.

Figure 8A:
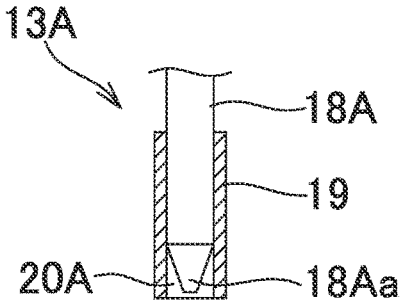
FIG. 8A is a longitudinal cross-sectional view of a tip portion of an application body having another structure.
Figure 8B:
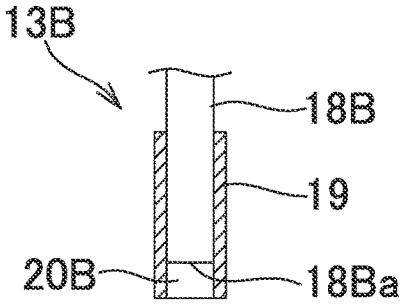
FIG. 8B is a longitudinal cross-sectional view of a tip portion of an application body having still another structure.
Figure 8C:
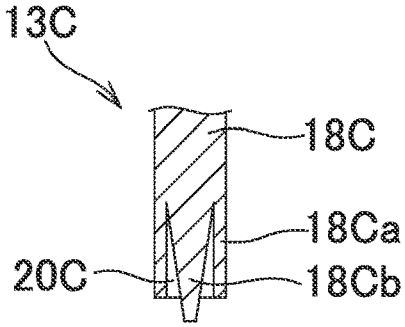
FIG. 8C is a longitudinal cross-sectional view of a tip portion of an application body having still another structure.
Figure 8D:
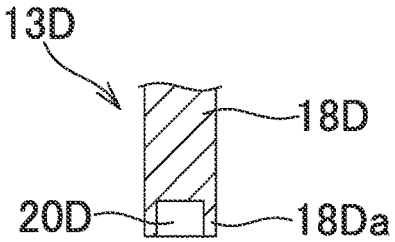
FIG. 8D is a longitudinal cross-sectional view of a tip portion of an application body having still another structure.

The protrusion 18*a* may not necessarily protrude downward of the lower end portion of the application tube 19. As in an application body 13A shown in FIG. 8A, a support rod 18A that includes a protrusion 18Aa having the lower end portion disposed slightly above the lower end portion of the application tube 19 may be used instead of the support rod 18, to form a tip recess 20A between the tip portion of the application tube 19 and the protrusion 18Aa. Furthermore, as in an application body 13B shown in FIG. 8B, instead of the support rod 18, a support rod 18B in which an end face 18Ba orthogonal to the axial direction is disposed, at the lower end portion of the support rod 18B, slightly above the lower end portion of the application tube 19 without providing the protrusion 18*a*, may be disposed to form a tip recess 20B inside the application tube 19. Moreover, as in an application body 13C shown in FIG. 8C, instead of the support rod 18, a support rod 18C integrally having a tubular portion 18Ca at the lower end portion may be used without providing the application tube 19 to form a tip recess 20C between the tubular portion 18Ca and a protrusion 18Cb. In addition, as in an application body 13D shown in FIG. 8D, instead of the support rod 18, a support rod 18D that has a tubular portion 18Da at the lower end portion and does not have the protrusion 18*a* may be used without providing the application tube 19 to form a tip recess 20D inside the tubular portion 18Da. Furthermore, as in an application body 13E shown in FIG. 8E, instead of the support rod 18, a support rod 18E which includes a tip recess 20E formed by almost the entirety of the lower end face being recessed so as to form a partially spherical shape may be used without providing the application tube 19. The tip recess 20E having such a structure allows the outer peripheral edge of the tip recess 20E to firmly engage with the to-be-coated surface 2, and the support rod 18E can be prevented from slipping relative to the to-be-coated surface 2, thereby forming the coated portion 5A having a perfect round shape.

An annular or a helical outer circumferential groove portion may be formed as the holding recess on the outer circumferential surface of the tip portion of the application body, in addition to the tip recess or without providing the tip recess.

For example, an annular or a helical outer circumferential groove portion can be formed in the outer circumferential surface of the tip portion of the application body 13, 13A to 13E and used in combination with the tip recess 20, 20A to 20E disposed on the tip face of the application body 13, 13A to 13E. Specifically, as in an application body 13F shown in FIG. 8F, instead of the support rod 18, a support rod 18F that has a helical outer circumferential groove portion 25 in the outer circumferential surface, and has the tip recess 20E formed by almost the entirety of the lower end face being recessed so as to form a partially spherical shape may be used without providing the application tube 19. In a case where the application tube 19 is disposed, an outer circumferential groove portion is formed as a helical groove or an annular groove in the outer circumferential portion of the application tube 19.

Figure 8E:
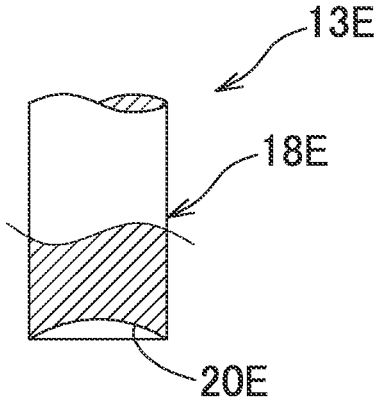
FIG. 8E is a front view of a longitudinal cross-section of a main portion of a tip portion of an application body having still another structure.
Figure 8F:
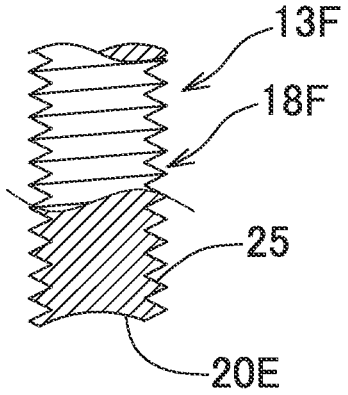
FIG. 8F is a front view of a longitudinal cross-section of a main portion of a tip portion of an application body having still another structure.
Figure 8G:
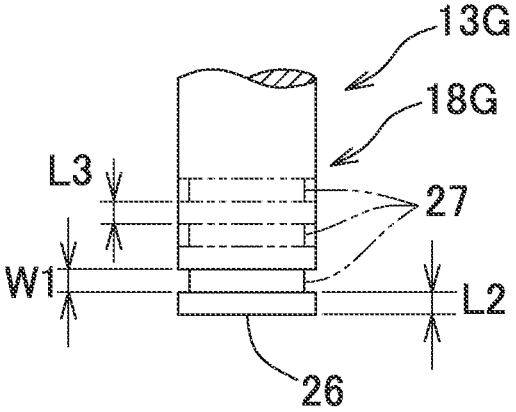
FIG. 8G is a front view of a tip portion of an application body having still another structure.

In a case where an outer circumferential groove portion is formed as a helical groove or an annular groove in the outer circumferential surface of the tip portion of the application body without providing a tip recess, for example, a support rod 18G having a flat surface 26 orthogonal to the length direction on the lower end face and an outer circumferential groove portion 27 that is an annular groove formed near the lower end as the holding recess may be used, instead of the support rod 18, without providing the application tube 19, as in an application body 13G shown in FIG. 8G.

In a case where the outer circumferential groove portion 25 is formed as a helical groove, the groove cross-sectional shape, the groove width, the groove depth, and the groove pitch can be set as appropriate. For example, the outer circumferential groove portion 25 can be formed as a known thread groove such as an existing triangular thread, square thread, trapezoidal thread, buttress thread, or round thread groove.

In a case where the outer circumferential groove portion 27 is formed as an annular groove, a groove cross-sectional shape and a groove depth can be optionally set. A distance L2 from the tip of the application body 13G to the outer circumferential groove portion 27, the number of grooves, a groove width W1, a distance L3 between the grooves adjacent to each other, and the like can be each set to any distance that allows at least a part of the outer circumferential groove portion 27 to be immersed in coating liquid in the application tray 4 when the coating liquid in the application tray 4 is adhered to the tip portion of the application body.

Specifically, the distance L2 from the tip of the application body 13G to the outer circumferential groove portion 27 is preferably 0.5 mm or more and 7 mm or less, and more preferably 1 mm or more and 5 mm or less.

The groove width W1 of the outer circumferential groove portion 27 is preferably 0.4 mm or more, more preferably 0.6 mm or more, and even more preferably 1.0 mm or more. The upper limit value of the groove width W1 is not particularly limited. However, the upper limit value can be set to a value of the width that allows almost the entirety of the outer circumferential groove portion 27 to be immersed in coating liquid when the tip portion of the application body 13G is pressed against the liquid absorber 3 in the application tray 4.

The number of the outer circumferential groove portions 27 may be one, but is preferably plural. The upper limit value of the number of the outer circumferential groove portions 27 is not particularly limited. However, the upper limit value can be set to a value of the number that allows the outer circumferential groove portion 27 disposed at the uppermost position to be immersed in coating liquid when the tip portion of the application body 13G is pressed against the liquid absorber 3 in the application tray 4.

In the present embodiment, the outer circumferential groove portion as the helical groove or the annular groove is formed as the holding recess disposed on the outer circumferential surface of the tip portion the application body. Here, an annular stepped portion having a large diameter on the lower end side of the application body may be disposed near the lower end of the application body instead of the helical groove and the annular groove.

Thus, in a case where at least one of (i) the tip recess 20, 20A to 20E and (ii) the outer circumferential groove portion 25, 27 is disposed at the tip portion of the application body, defects such as liquid dripping of the unit coating liquid 5 adhered to the tip portion of the application body due to, for example, vibration during operation of the application tool body 10 can be effectively prevented. Furthermore, variation in an amount of coating liquid adhered to the to-be-coated surface 2 and variation in a diameter of the coated portion 5A, which are caused by the difference in a time period during which the application body 13 is pressed against the to-be-coated surface 2 depending on an operator, can be reduced.

As shown in FIG. 2 and FIG. 3, a screw portion 18*b* is formed at the upper half portion of the support rod 18. A regulation nut 21 for preventing the support rod 18 from dropping is screwed onto the upper end portion of the support rod 18. A nut member 22 is screwed onto a mid-portion of the support rod 18. The first urging members 14 that are compression coil springs are disposed on the outer side of the support rods 18 between the support plate 12 and the nut members 22. The application bodies 13 are constantly urged by the first urging members 14 separately toward the lower limit positions indicated by the solid lines, respectively, in FIG. 3.

Figure 5:
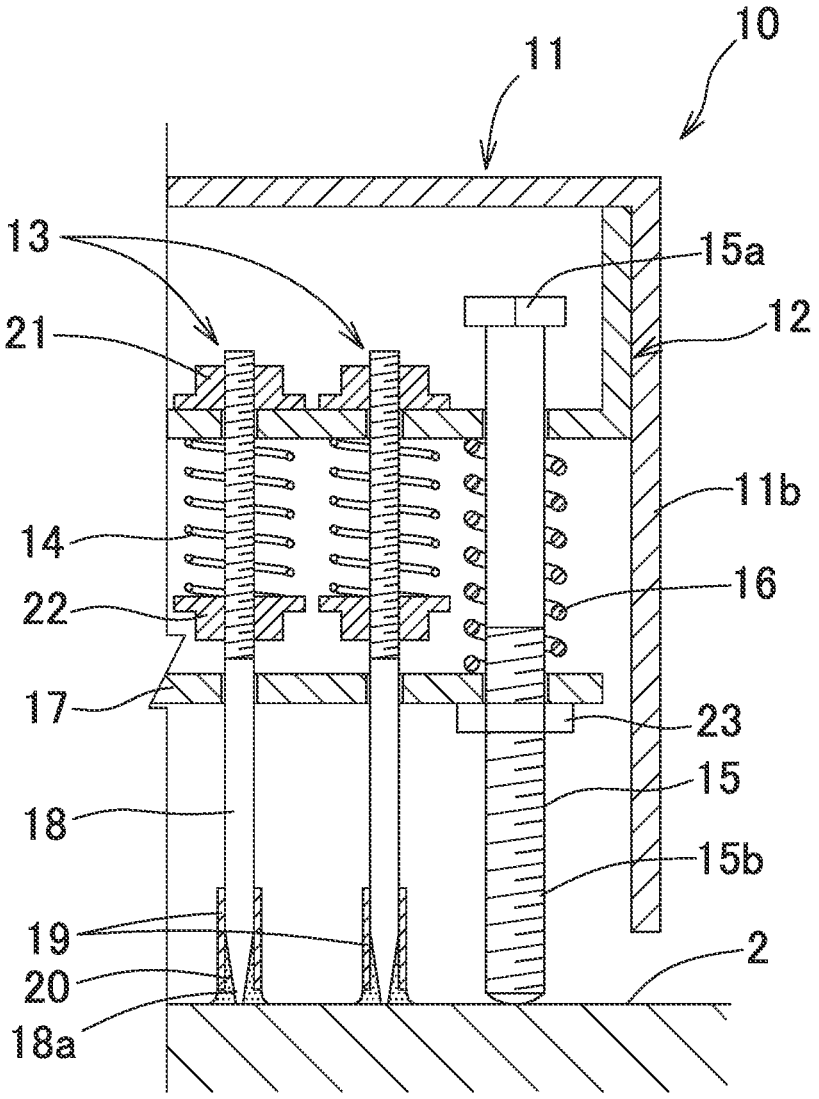
FIG. 5 illustrates a state where the coating liquid is being applied to the to-be-coated surface.
Figure 6:
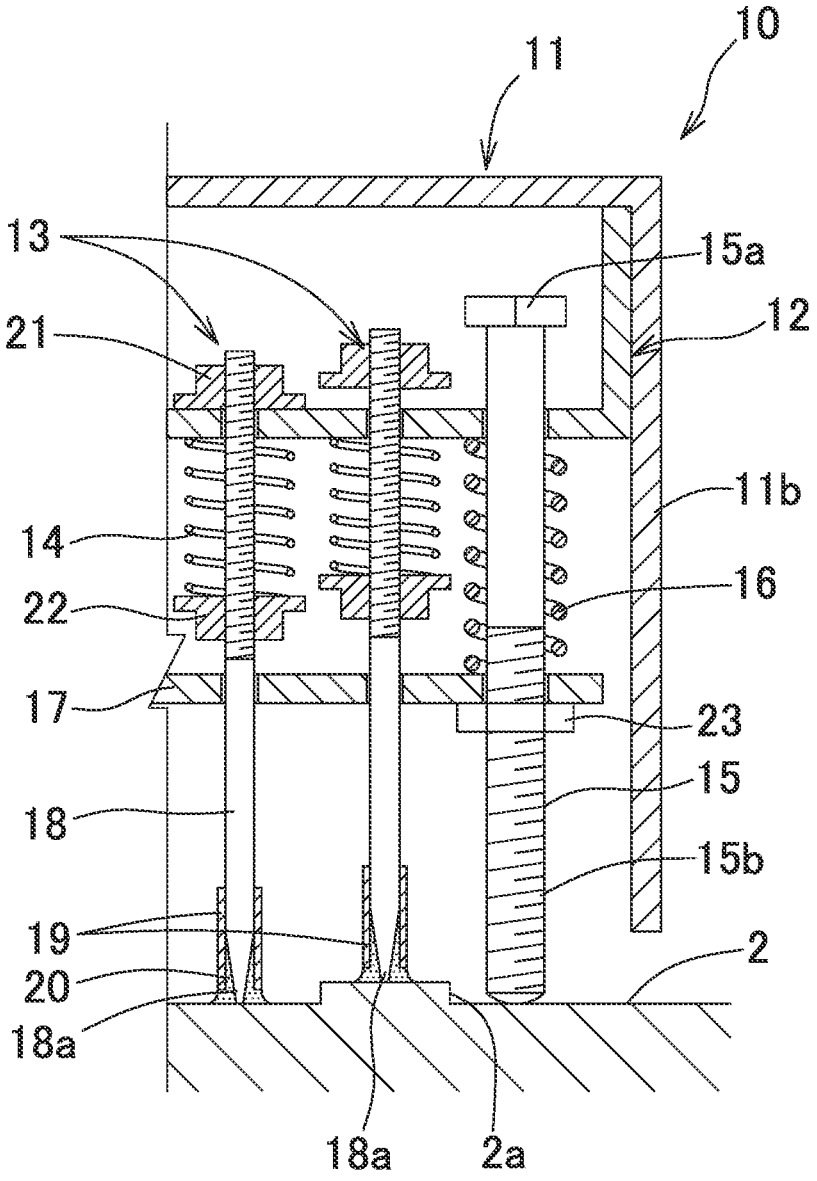
FIG. 6 illustrates a state where the coating liquid is being applied to a to-be-coated surface having a protrusion.

The plurality of application bodies 13 are assembled in the support plate 12 so that the height positions of the lower end portions of the application bodies 13 are aligned at almost the same level at the lower limit positions in a state where the application tool body 10 is horizontally held. The lower end portion of the application body 13 is disposed below the lower end portion of the side wall portion 11*b* of the casing 11 at the lower limit position as shown in FIG. 3. When the lower end portion of the application body 13 is brought into contact with the to-be-coated surface 2 as shown in FIG. 5, and thereafter, the application tool body 10 is further moved downward, the application body 13 moves relatively upward against the urging force of the first urging member 14. Thus, an excessive force is prevented from acting on the application body 13. Furthermore, in a case where the to-be-coated surface 2 has an uneven portion or a stepped portion such as a protrusion 2*a* as shown in FIG. 6, the height of the application body 13 is adjusted according to the uneven portion or the stepped portion, whereby the unit coating liquid 5 can be applied well to the uneven to-be-coated surface without leaving any portion uncoated.

As shown in FIG. 2 and FIG. 3, a bolt head portion 15*a* for preventing dropping of the guide rod 15 from the support plate 12 is disposed at the upper end portion of the guide rod 15. A screw portion 15*b* is formed at the lower half portion of the guide rod 15. A nut member 23 is screwed onto the screw portion 15*b*, and the height of the guide plate 17 can be adjusted by the nut member 23. The second urging member 16 formed as a compression coil spring is disposed on the outer side of the guide rod 15 between the support plate 12 and the guide plate 17, and the guide plate 17 and the guide rod 15 are constantly urged downward by the second urging member 16.

The lower end portion of the guide rod 15 is disposed, in a state where no external force acts, at a lower position below the lower end portion of the application body 13 disposed at the lower limit position, as indicated by the solid line in FIG. 3. The tip portion of the application body 13 does not come into contact with the to-be-coated surface 2 if the application tool body 10 is just placed on the to-be-coated surface 2, as shown in FIG. 4. Thus, positions of the guide rods 15 relative to the to-be-coated surface 2 are appropriately adjusted in a state where the application tool 1 is placed on the to-be-coated surface 2, thereby applying the unit coating liquid 5 to an appropriate position. More specifically, as shown in FIG. 4, the application tool body 10 is aligned with and placed on the to-be-coated surface 2, and the application tool body 10 is pressed downward in this state. Thus, as shown in FIG. 5, the guide rod 15 is moved relatively upward against an urging force of the second urging member 16, and the tip portion of the application body 13 is moved downward together with the support plate 12 and pressed against the to-be-coated surface 2, and the unit coating liquid 5 held at the tip portion of the application body 13 can be applied to the to-be-coated surface 2.

The first urging member 14 and the second urging member 16 can be formed as a spring member other than a compression coil spring or an elastic member such as synthetic rubber. Furthermore, the nut member 23 may receive the lower end portion of the second urging member 16 without providing the guide plate 17. Moreover, a plate-like member, a shaft-like member, or the like may be provided at the guide plate 17 so as to protrude downward of the lower end portion of the application body 13 without causing the guide rod 15 to protrude downward of the lower end portion of the side wall portion 11*b* of the casing 11. Furthermore, the support plate 12 may be held between the nut member 22 and the regulation nut 21 without providing the first urging member 14, to thereby fix the application body 13 to the support plate 12 so as not to move in the up-down direction. Furthermore, the second urging members 16, the guide rods 15, and the guide plate 17 may be omitted. In the present embodiment, the tip portion of the application body 13 is pressed against the liquid absorber 3 to hold and adhere the unit coating liquid 5 at and to the tip portion of the application body 13. However, the support rod 18 may be formed in a hollow pipe shape, and, for example, a position sensor for detecting upward movement of the application body 13 relative to the casing 11 each time the unit coating liquid 5 is applied to the to-be-coated surface 2, and a pump for supplying coating liquid for one application to the tip portion of the application body 13 through the support rod 18 each time a detection signal is outputted from the position sensor, may be provided.

Next, an antislip treatment method w-ill be described. In the antislip treatment method, the unit coating liquid 5 having an antislip treatment composition, in a liquid state, which contains curable resin is applied to the to-be-coated surface 2 such as a floor surface in a building by using the above-described application tool 1, and the coated portions 5A having the antislip treatment composition are formed on the to-be-coated surface 2 at intervals in the line direction and the column direction. However, the above-described application tool 1 can also be used for applying coating liquid other than an antislip treatment composition to a floor surface in a building or the to-be-coated surface 2 other than the floor surface.

First, dirt and dust on the to-be-coated surface 2 are removed by a vacuum cleaner, and then the to-be-coated surface 2 is cleaned with, for example, a paper towel containing acetone. Thereafter, a masker having a masking tape and a curing sheet integrated with each other is adhered so as to cover a portion in which the antislip treatment is unnecessary, for example, for covering a joint between the flooring materials. Meanwhile, as shown in FIG. 1 to FIG. 3, the application tray 4 having the liquid absorber 3 such as a sponge or a nonwoven fabric placed therein is filled with the antislip treatment composition, and the liquid absorber 3 is impregnated with the antislip treatment composition. However, the application tray 4 may be filled directly with the antislip treatment composition without providing the liquid absorber 3.

Next, the operation rod 31 of the application tool 1 is first held by a hand to move the application tool body 10 upward in order to form the coated portions 5A as dots on the to-be-coated surface 2 by means of the application tool 1. As shown in FIG. 2 and FIG. 3, the application tool body 10 is disposed above the application tray 4 such that all the application bodies 13 of the application tool body 10 face the liquid absorber 3. As indicated by an imaginary line in FIG. 3, the application tool body 10 is moved downward, and the lower end portions of the guide rods 15 are placed on the to-be-coated surface 2, and the lower end portions of the application bodies 13 are pressed against the liquid absorber 3. Thus, as shown in FIG. 7B, a portion, of the liquid absorber 3, corresponding to each application body 13 is recessed by the weight of the application tool itself, the antislip treatment composition with which the liquid absorber 3 has been impregnated exudes, and the lower end portion of the application body 13 is immersed in the antislip treatment composition. At this time, if the antislip treatment composition with which the liquid absorber 3 has been impregnated does not sufficiently exude, the operation rod 31 is pressed downward to slightly press the application tool body 10 downward against the urging force of the second urging member 16. Thus, the antislip treatment composition sufficiently exudes, and the lower end portion of the application body 13 is immersed in the antislip treatment composition.

Thus, the lower end portions of the application bodies 13 are immersed in the antislip treatment composition, and the antislip treatment composition is thus held in the tip recesses 20 through capillary phenomenon. The application tool body 10 is moved upward, and the unit coating liquid 5 is held by the lower end portion of each application body 13 in an amount required for one application so as to form an almost semispherical shape, as shown in FIG. 7C and FIG. 7D. The lower end portion of the support rod 18 protruding downward of the tip portion of the application tube 19 is inserted in the unit coating liquid 5, and the unit coating liquid 5 is held so as not to easily drip from the lower end portion of the application body 13 due to, for example, vibration during movement of the application tool body 10.

Next, in a state where the unit coating liquid 5 is held at the tip portion of the application tool 1, the lower end portions of the guide rods 15 are brought into contact with the to-be-coated surface 2 near a position of the to-be-coated surface 2 at which the unit coating liquid 5 is applied, thereby placing the application tool body 10, as shown in FIG. 4. In this state, the application tool body 10 is positioned at and aligned with the appropriate position of the to-be-coated surface 2 while the outer edge of the casing 11 or the guide rods 15 are visually checked. Thereafter, as shown in FIG. 5 and FIG. 7E, the application tool body 10 is pressed downward against the urging force of the second urging member 16 to allow the tip portions of the support rods 18 to be brought into contact with the to-be-coated surface 2, and the unit coating liquid 5 adhered to the lower end portions of the application bodies 13 is pressed against the to-be-coated surface 2 to adhere the unit coating liquid 5 to the to-be-coated surface 2. As shown in FIG. 7F and FIG. 7G, the application tool body 10 is moved upward, and a plurality of the coated portions 5A formed of the unit coating liquid 5 adhered to the to-be-coated surface 2 are formed on the to-be-coated surface 2.

Thus, in the application of the unit coating liquid 5 with using the application tool 1, positions at which the application to the to-be-coated surface 2 is performed are sequentially changed, and a plurality of dot-shaped coated portions 5A having the antislip treatment composition are formed at intervals in the line direction and the column direction in portions at which application to the to-be-coated surface 2 is required. After the antislip treatment composition has been applied, for example, the antislip treatment composition is left as it is for a certain time period, heated, or irradiated with ultraviolet rays depending on the compositional structure of the antislip treatment composition, to harden the applied antislip treatment composition, thereby forming, on the to-be-coated surface 2, the antislip protrusion including a plurality of the coated portions 5A.

Thus, the application tool 1 includes the support plate 12, and the plurality of application bodies 13 disposed at the support plate 12 so as to protrude, and the tip recesses 20 serving as the holding recesses that allow coating liquid to be held therein are disposed in the tip portions of the plurality of application bodies 13, respectively. Therefore, the tip portion of the application body 13 is immersed in coating liquid or is pressed against the liquid absorber 3 such as a sponge or a nonwoven fabric containing the coating liquid, whereby the coating liquid is stored in the tip recess 20 serving as the holding recess and is held so as to protrude from the tip portion of the application body 13 and form a semispherical shape, as shown in FIG. 7C and FIG. 7D. Thus, the unit coating liquid 5 is held by the tip portion of the application body 13 in an amount required for one application. In this state, the tip portions of the application bodies 13 are brought into contact with the to-be-coated surface 2, and the unit coating liquid 5 held by the tip portions of the application bodies 13 is thus applied to the to-be-coated surface 2, whereby the coated portions 5A can be formed. The application bodies 13 are disposed at the support plate 12 so as to align the height positions of the tips with each other. Therefore, the unit coating liquid 5 held by the tip portions of the application bodies 13 can be simultaneously applied to the to-be-coated surface 2. Thus, by using the application tool 1, a plurality of the coated portions 5A having the antislip treatment composition can be formed in a region of, for example, 600 mm x200 ram at intervals in the line direction and the column direction in one application operation. The unit coating liquid 5 can be directly applied as dots to the to-be-coated surface 2 without using a masking sheet or the like. Therefore, an amount of waste can be reduced, and, furthermore, the coated portion 5A such as the antislip protrusion can be easily formed in a short time period.

The protrusion 18*a* is disposed at the bottom portion of the tip recess 20 so as to protrude toward the opening of the tip recess 20. Therefore, the unit coating liquid 5 can be held at the tip of the application body 13 through capillary phenomenon in a gap between the inner face of the tip recess 20 and the protrusion 18*a* such that the unit coating liquid 5 does not easily drop due to vibration during, for example, operation of the application tool body 10.

Furthermore, each of the plurality of application bodies 13 includes the support rod 18 disposed at the support plate 12 so as to protrude, and the application tube 19 disposed on the outer side of the tip portion of the support rod 18 so that the tips of the application tubes 19 are aligned with each other. The tip recesses 20 are formed in the tip portions of the plurality of the application tubes 19, respectively. Therefore, the application tube 19 made of a flexible material such as elastomer is used, whereby damage to the to-be-coated surface 2 due to contact with the application tube 19 can be effectively prevented also in a case where the application tube 19 is pressed against the to-be-coated surface 2 for the application of the coating liquid.

Figure 9:
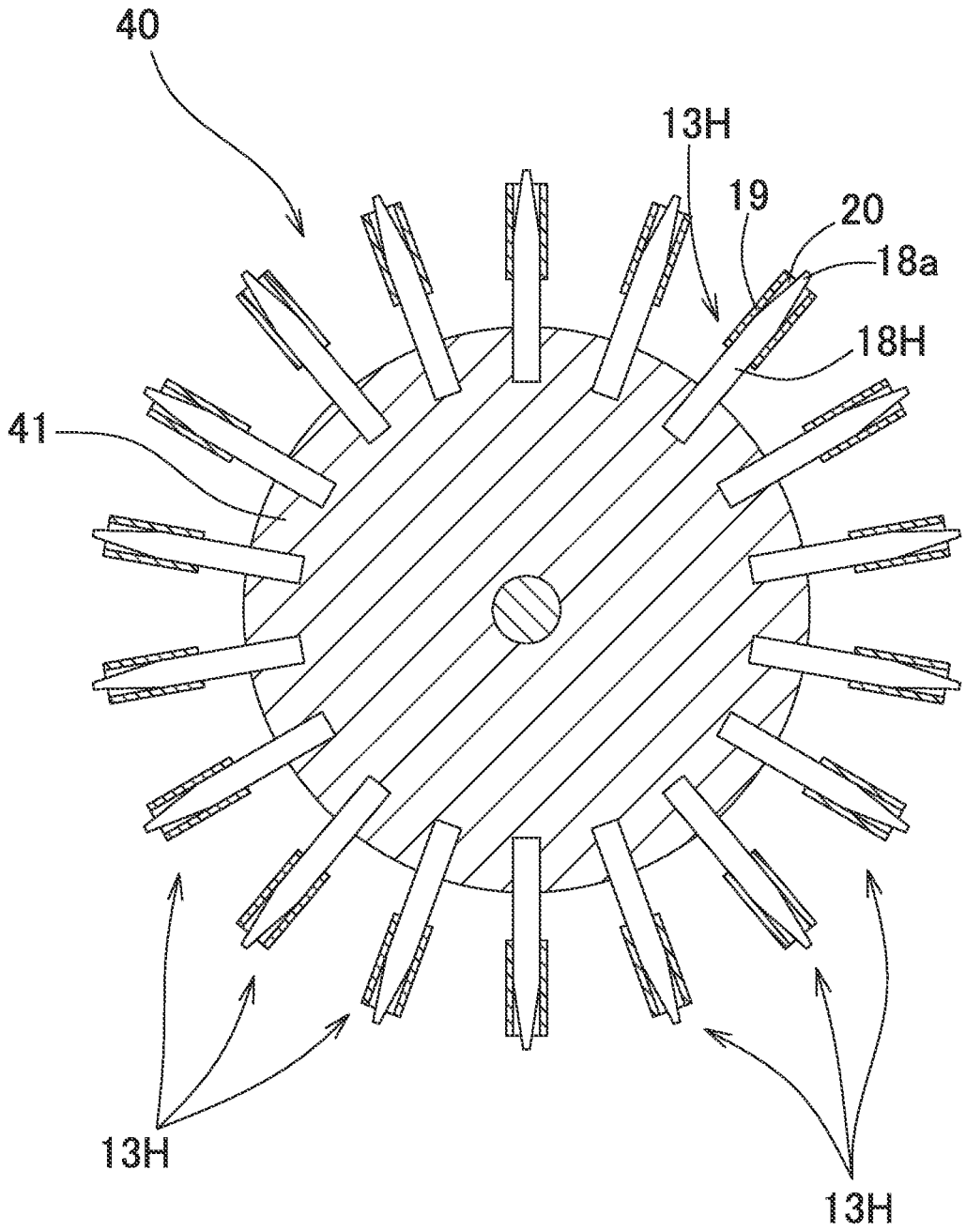
FIG. 9 illustrates another structure of an application tool body.

The support plate 12 is formed as a flat plate. Therefore, it is advantageous in that a structure for attaching the application body 13 to the support plate 12 can be simplified. Here, for example, an application tool body 40 shown in FIG. 9 may be provided. In the application tool body 40, short support rods 18H are radially embedded in a columnar base member 41 at intervals in the circumferential direction and the length direction, the application tube 19 is fitted and fixed to the outer side of the tip portion of each support rod 18H, and a plurality of application bodies 13H including the support rods 18H and the application tubes 19 are disposed in the base member 41.

The plurality of application bodies 13 are disposed at the support plate 12 so as to be movable in the up-down direction, and the first urging members 14 for constantly urging the plurality of application bodies 13 toward the lower limit positions are disposed separately for the plurality of application bodies 13, respectively. Therefore, also when the to-be-coated surface 2 has an uneven portion, the application bodies 13 are moved along the uneven portion of the to-be-coated surface 2 in the length direction, whereby the tip portions of all the application bodies 13 are brought into contact with the to-be-coated surface 2 without forming gaps, and the unit coating liquid 5 can be applied so as not to cause deficient application.

The guide rod 15 (guide member) is disposed at the support plate 12 so as to be movable in the up-down direction between an upper position at which the lower end portion of the guide rod 15 is disposed above the lower end portion of the application body 13, and a lower position at which the lower end portion of the guide rod 15 is disposed below the lower end portion of the application body 13. The second urging member 16 for constantly urging the guide rod 15 toward the lower position is disposed. Therefore, when the application tool 1 is placed on the to-be-coated surface 2 or the like, the guide rod 15 can prevent the tip portion of the application body 13 from coming into contact with the to-be-coated surface 2, and damage to the tip portion of the application body 13 can be effectively prevented. The application tool 1 is pressed toward the to-be-coated surface 2 against the urging force of the second urging member 16 in a state where the application body 13 is disposed at the appropriate position on the to-be-coated surface 2 by aligning the guide rod 15 with the to-be-coated surface 2, whereby the tip portion of the application body 13 can be pressed against the to-be-coated surface 2, and the unit coating liquid 5 can be applied accurately to the appropriate position on the to-be-coated surface 2.

The guide plate 17 for guiding the mid-portions of the plurality of application bodies 13 so that the mid-portions of the application bodies 13 are movable in the length direction, is disposed at the guide rods 15 (guide member) so as to be parallel with the support plate 12, and the mid-portions of the application bodies 13 are guided in the up-down direction by the guide plate 17. Therefore, the orientation stability of the application body 13 can be enhanced, deformation of the application body 13 due to an external force can be prevented, and the unit coating liquid 5 can be applied to the to-be-coated surface 2 at an appropriate position.

Next, another embodiment of the application tool 1 will be described with reference to the drawings. The components same as those in the above-described embodiment are denoted by the same reference numerals, and the detailed description thereof is omitted.

Figure 10A:
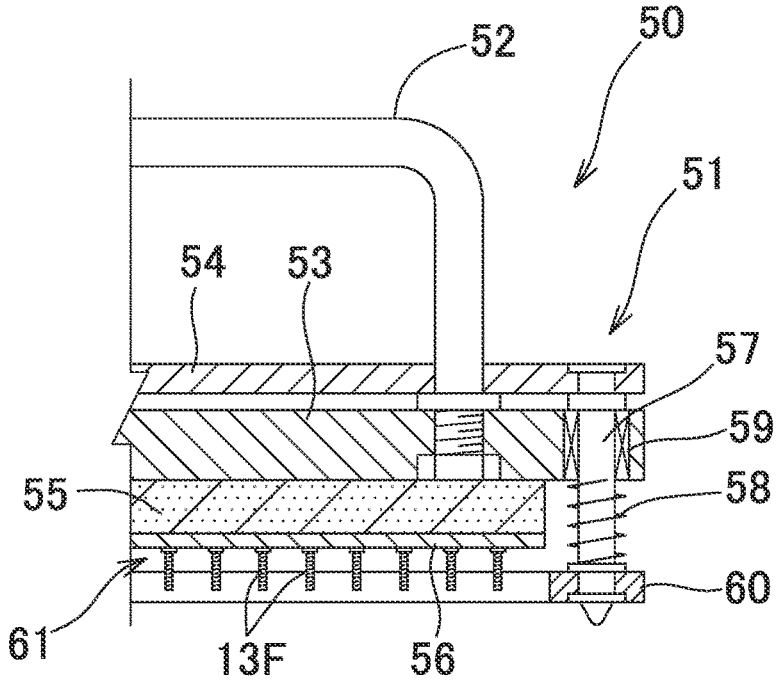
FIG. 10A is a longitudinal cross-sectional view of a main portion of an application tool having still another structure.

As shown in FIG. 10A, an application tool 50 includes an application tool body 51 and a handle member 52 for an operation of pressing the application tool body 51. The application tool body 51 includes a pressing plate 53 to which the handle member 52 is attached, an upper face plate 54 disposed on the upper face side of the pressing plate 53, a cushion member 55 disposed on the lower face side of the pressing plate 53, a support plate 56 disposed on the lower face side of the cushion member 55, a plurality of application bodies 13F disposed at the support plate 56 so as to protrude downward, a guide member 57 disposed at the side portion of the pressing plate 53 so as to be movable in up-down direction, and a second elastic member 58 for constantly urging the guide member 57 downward. Here, instead of the application body 13F, the application body 13, 13A to 13E, and 13G of the above-described embodiment may be disposed.

The handle member 52 penetrates through the upper face plate 54 and is fixed to the pressing plate 53, and an operator is allowed to operate the application tool body 51 by grasping the handle member 52 with her/his hand. The handle member 52 can have any structure as long as the application tool body 51 can be operated. For example, the downward-facing U-shaped handle members 52 may be disposed parallel to each other with a distance from each other in the left-right direction or may be angled so as to form an inverted-V-shape in a planar view, whereby the handle members 52 are held by right and left hands to operate the application tool body 51. Instead of the handle member 52, the operation portion 30 of the above-described embodiment may be attached to the pressing plate 53.

The pressing plate 53 is formed as a plate-like member that is formed of a metal material, a synthetic resin material, wood, or the like and that has excellent bending stiffness. The pressing plate 53 allows the pressing operation force of the handle member 52 to act almost uniformly on the entire upper face of the cushion member 55.

The cushion member 55 may have any structure as long as the cushion member 55 can be compressively deformed, and can be restored to an original shape. For example, the cushion member 55 is formed of a sponge made of polyurethane or the like.

The guide member 57 is formed as a shaft-like member made of a metal or synthetic resin. The guide members 57 are disposed at regular intervals in the front and the rear portions on both the left and right sides of the pressing plate 53, and are movable in the up-down direction so as to penetrate through the pressing plate 53 via guide members 59 each formed as a linear bush. The upper end portion of the guide member 57 is fixed to the upper face plate 54, and the lower end portion of the guide member 57 is fixed to a frame-shaped lower frame 60 disposed so as to surround the support plate 56, and a plurality of the guide members 57 move in the up-down direction in synchronization with the upper face plate 54 and the lower frame 60. The second elastic member 58 formed as a compression coil spring is disposed on the outer side of each guide member 57 between the pressing plate 53 and the lower frame 60. The guide member 57 is constantly urged by the second elastic member 58 toward the lower limit position, shown in FIG. 10A, at which the lower end portion of the guide member 57 is below the lower end portion of the application body 13F after movement of the guide member 57. The lower end portion of the guide member 57 is acuminated so as to facilitate alignment with the to-be-coated surface 2. Here, it is also preferable that a free bearing is disposed in the lower end portion of the guide member 57 to facilitate alignment of the application tool body 51.

The support plate 56 is formed as a plate-like member that is made of a metal material, a synthetic resin material, wood, or the like and that has excellent bending stiffness. The plurality of application bodies 13F protruding downward are disposed at the support plate 56 so as to align the height positions of the tips with each other. An application unit 61 is formed by the support plate 56 and the plurality of application bodies 13F, and the application unit 61 is fixed to the lower face of the cushion member 55 by an adhesive or the like. Here, the application unit 61 may be detachably attached to the lower face of the cushion member 55 by a not-illustrated attaching tool such as a touch fastener or a magnet in order to enhance maintainability. The application body 13F can be fixed to the support plate 56 by an adhesive or by any fixing structure such as a bolt and nut.

If coating liquid is applied to the to-be-coated surface 2 by using the application tool 50, the handle member 52 of the application tool 50 is first held by a hand, the lower end portions of the application bodies 13F are pressed against the liquid absorber 3 in the application tray 4 as in the above-described embodiment, and an antislip treatment composition as the coating liquid is adhered to the lower end portions of the application bodies 13F.

Figure 10B:
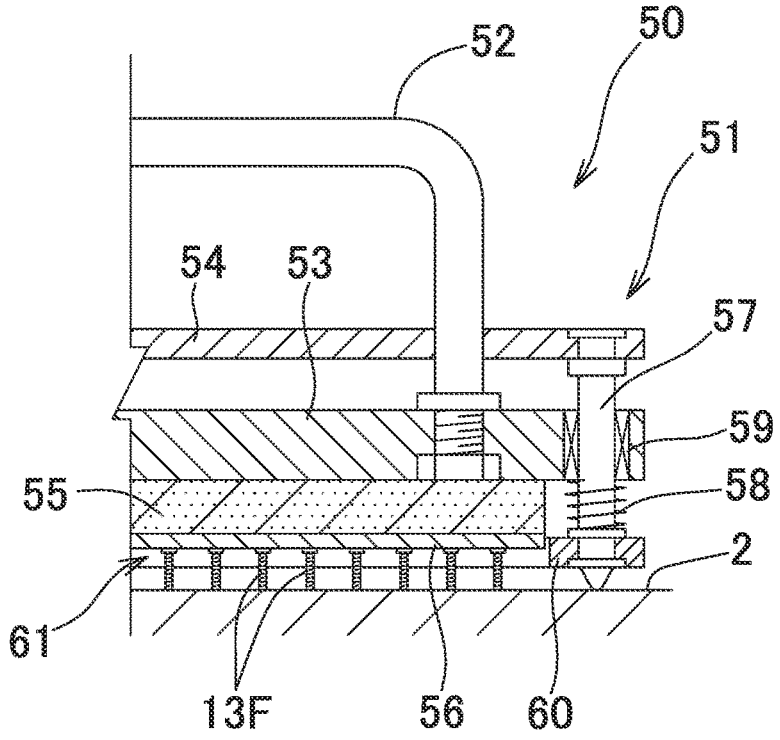
FIG. 10B illustrates the application tool in an application operation.

Next, in a state where the unit coating liquid 5 is held at the tip portions of the application bodies 13F, the application tool body 51 is placed on the to-be-coated surface 2, and the application tool body 51 is positioned at and aligned with the appropriate position of the to-be-coated surface 2. Thereafter, as shown in FIG. 10B, the pressing plate 53 is pressed downward against the urging force of the second elastic member 58, and the lower end portions of the application bodies 13F are pressed against the to-be-coated surface 2 so as to slightly compress the cushion member 55, and the unit coating liquid 5 in the lower end portions of the application bodies 13F is adhered to the to-be-coated surface 2, to form, on the to-be-coated surface 2, a plurality of the coated portions SA formed of the unit coating liquid 5.

Thus, the unit coating liquid 5 is sequentially applied by using the application tool 50, and the antislip treatment composition is then, for example, left as it is for a certain time period, heated, or irradiated with ultraviolet rays depending on the compositional structure of the antislip treatment composition, to harden the applied antislip treatment composition, thereby forming, on the to-be-coated surface 2, the antislip protrusion including a plurality of the coated portions 5A.

In the application tool 50, unlike the application tool 1 of the above-described embodiment, the application bodies 13F are not moved separately in the up-down direction. Therefore, the structure of the application tool 50 can be substantially simplified, and the production cost is thus reduced. The cushion member 55 allows pressing operation force to act almost uniformly on the plurality of application bodies 13F disposed in the application tool 50. Therefore, variation in an amount of applied coating liquid and variation in a diameter of the coated portion 5A due to variation in pressing operation force can be minimized.

Figure 11A:
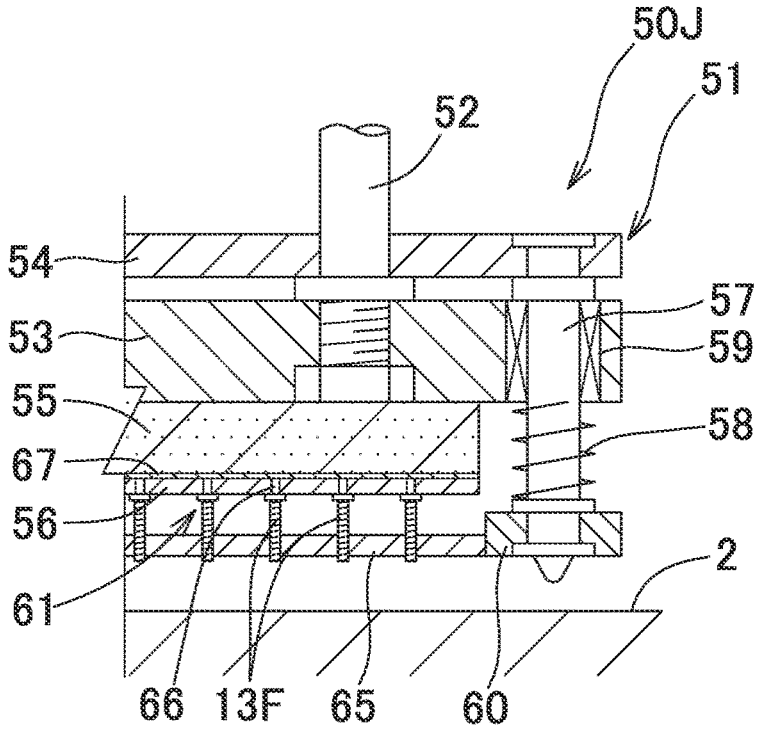
FIG. 11A is a longitudinal cross-sectional view of a main portion of an application tool having still another structure.

As in an application tool 50J shown in FIG. 11A, a guide plate 65 having a plurality of insertion holes through which the mid-portions of the application bodies 13F are inserted may be disposed so as to be integrated with the lower frame 60, so that the mid portions of the application bodies 13F can be guided by the guide plate 65 so as to be movable in the up-down direction. Instead of the support plate 56, a support plate 56J formed as a rubber plate may be disposed such that the application bodies 13F can be slightly moved independently in the up-down direction due to deformation of the cushion member 55. Furthermore, it is also preferable that through holes 66 for promoting deformation of the support plate 56J are formed at positions of the support plate 56J at which the application bodies 13F are attached. Reference character 67 represents an attaching tool formed as a touch fastener or a magnet plate for detachably attaching, to the cushion member 55, an application unit 61J including the support plate 56 and the plurality of application bodies 13F.

Figure 11B:
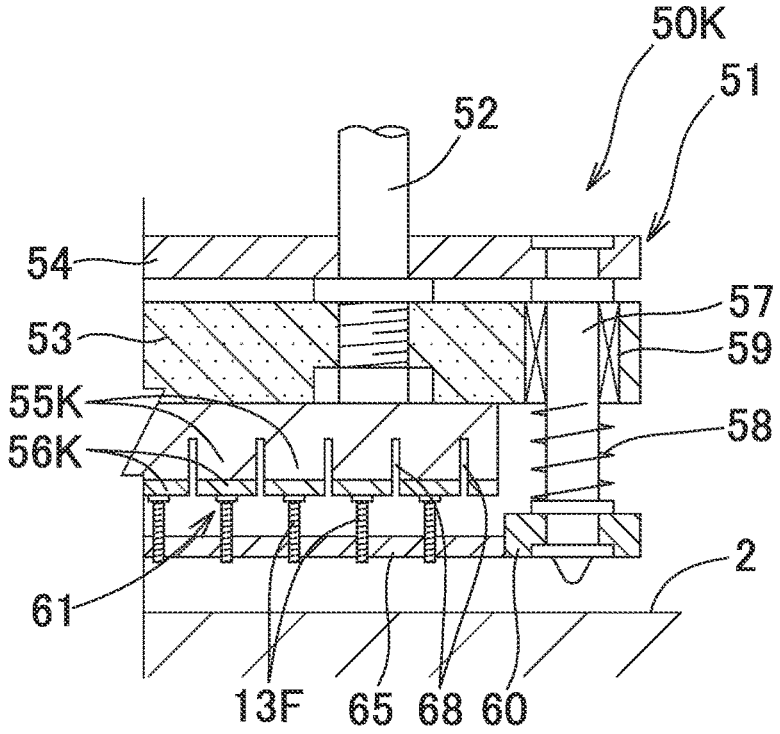
FIG. 11B is a longitudinal cross-sectional view of a main portion of an application tool having still another structure.

In the application tool 50J, the support plate 56J is formed as a rubber plate. Therefore, even if the to-be-coated surface 2 has the protrusion 2*a* as shown in FIG. 6, the application body 13F corresponding to the protrusion 2*a* is independently moved in the up-down direction, whereby coating liquid can be fully applied to the upper face of the protrusion 2*a* without non-uniformity. As in an application tool 50K shown in FIG. 11B, cut portions 68 for sectioning the plurality of application bodies 13F into the individual application bodies 13F so as to form a grid-like shape may be disposed at the support plate 56 and the lower portion of the cushion member 55, so that the individual application bodies 13F can be easily moved independently in the up-down direction by unit cushion members 55K and unit support plates 56K sectioned by the cut portions 68.

Next, a specific compositional structure of the antislip treatment composition will be described.

The antislip treatment composition is a curable composition containing curable resin. The curable resin is not particularly limited. However, the curable resin is preferably at least one selected from the group consisting of moisture curable resin, thermosetting resin, and photocurable resin, in consideration of, for example, a contact angle of the antislip protrusion.

The moisture curable resin is not particularly limited, and a known moisture curable resin can be used. For example, modified silicone resin that is hardened by moisture can be preferably used. Examples of the modified silicone resin include an antislip treatment composition which contains a curable component that is hardened by moisture and that contains 8 to 92 weight % of crosslinkable-silyl-group-containing polymer (hereinafter, may be referred to as "curable polymer component") and 8 to 92 weight % of alkoxy-group-containing silicone oligomer (hereinafter, may be referred to as "curable oligomer component"). Furthermore, the antitreatment composition may optionally contain at least one component selected from a curing catalyst, an additive for resin, and a silane compound other than the crosslinkable-silyl-group-containing polymer and the alkoxy-group-containing silicone oligomer. Hereinafter, the antislip treatment composition containing the modified silicone resin as the curable resin is referred to as a curable composition (X), and essential components and optional components of the curable composition (X) will be described in more detail.

The curable polymer component is not particularly limited as long as the curable polymer component is a polymer having a crosslinkable silyl group. Here, the curable polymer component is preferably a curable polymer component (A) that has a main chain backbone selected from the group consisting of polyoxyalkylene, polyoxyalkylene ether, and (meth)acrylic-acid-ester-based polymer, and has a crosslinkable silyl group that binds to a terminal and/or a side chain of the main chain backbone (more preferably, a terminal of the main chain backbone). In order to allow a cured product of the curable composition (X) to have adhesiveness to a flooring material, hardness, and durability such as wear resistance, in the curable polymer component (A), the average number of the crosslinkable silyl groups per one molecule is preferably 0.7 or more, more preferably 0.7 to 3.0, and particularly preferably 1.2 to 2.6.

The crosslinkable silyl group of the curable polymer component is a silyl group having a crosslinkable group that forms crosslinking through hydrolysis or the like, and is more specifically a silyl group having 1 to 3 crosslinkable substituents. For example, the substituent in the silyl group is at least one selected from the group consisting of a hydrogen atom, a halogen atom, an alkoxy group, an acyloxy group, a ketoxymate group, an amino group, an amide group, an acid amide group, an aminooxy group, a mercapto group, an alkenyl group, and an alkenyloxy group.

A number-average molecular weight of the curable polymer component is preferably 500 or more, more preferably 1000 or more, even more preferably 1000 to 100000, and particularly preferably 1000 to 60000.

A curable polymer component (A3) having (meth)acrylic-acid-ester-based polymer as the main chain backbone can also be produced by photopolymerization (photoirradiation at ordinary temperature to 50 to 60° C. for 4 to 30 hours) of a monomer compound selected from a (meth)acrylic-acid-ester-based compound and a vinyl compound, with a crosslinkable-silyl-group-containing disulfide compound, by using, as necessary, an organic solvent (toluene, xylene, hexane, ethyl acetate, dioctyl phthalate, or the like).

A commercially available product may be used as the curable polymer component (A3) having an acrylic-acid-ester-based polymer as the main chain backbone. Examples of the commercially available product include SILYL MA-480 (trade name, manufactured by KANEKA CORPORATION), and ARUFON (registered trademark) US-6110 (trade name, acrylic polymer having an alkoxysilyl group, the average number of the alkoxysilyl groups per one molecule is 0.9, the number-average molecular weight is 3000, manufactured by Toagosei Co., Ltd.).

In the curable composition (X), at least one selected from the group consisting of the curable polymer component (A1), the curable polymer component (A2), and the curable polymer component (A3) can be used as the curable polymer component (A).

In the curable composition (X), the curable oligomer component is not particularly limited as long as the curable oligomer component is an oligomer of a silane compound having an alkoxy group. Examples of the curable oligomer component include a curable oligomer component (B) represented by general formula (1).

$$[—Si(OR1)(R2)-O—]m \quad (1)$$

[wherein R1 represents an alkyl group. R2 represents an alkyl group, an aryl group, or a reactive functional group. m represents the number of repeating monomer units, and represents an integer from 2 to 100. m R1 and m R2 may be equal to each other or different from each other.] In general formula (1), the group —OR1 binds to a terminal on the silicon atom side and the group R2 binds to a terminal on the oxygen atom side in general. Furthermore, a silicon atom to which an alkoxy group binds may also be referred to as an alkoxysilyl group.

A commercially available product may be used as the curable oligomer component (B). Many commercially available products are available from many companies. Examples of commercially available products manufactured by Shin-Etsu Chemical Co., Ltd. include a curable oligomer component, having a reactive functional group, such as trade names: KR-511, KR-513, KR-516, and KR-517, and a curable oligomer component, having no reactive functional group, such as trade names: KR-213, KR-401N, KR-500, KR-510, KR-515, KR-9218, KC-89S, X-40-9225, X-40-9227, X-40-9246, and X-40-9250.

The commercially available curable oligomer component having no reactive functional group has, as a substituent, a methyl group or a methyl group and a phenyl group together with a methoxy group, for example, has a viscosity (25° C.) ranging from 5 to 160 mm/s (preferably 20 to 100 $mm^2/s$), has a refractive index (25° C.) ranging from 1.35 to 1.55 (preferably 1.39 to 1.54), and has a methoxy-group content ranging from 10 to 50 weight % (preferably 15 to 35 weight %).

One kind of the curable oligomer component may be used alone or two or more kinds of the curable oligomer components may be used in combination. Needless to say, two or more kinds of commercially available products may be blended and used.

In the curable component, a ratio between the curable polymer component to be used and the curable oligomer component to be used is not particularly limited. The ratio can be selected as appropriate according to various conditions such as a material of a floor surface on which the cured product of the curable composition (X) is formed, the shape and the size of the cured product, and physical properties designed for the cured product. Here, 8 to 92 weight % of the curable polymer component and 8 to 92 weight % of the curable oligomer component are preferably contained, 15 to 85 weight % of the curable polymer component and 15 to 85 weight % of the curable oligomer component are more preferably contained, and 35 to 65 weight % of the curable polymer component and 35 to 65 weight % of the curable oligomer component are even more preferably contained, with respect to the entire amount of the curable component.

The contents of the curable polymer component and the curable oligomer component in the curable component are in the above-described ranges, so that the cured product of the curable composition (X) can exhibit excellent properties described below. That is, an antislip structure that has all of adhesiveness to a floor surface, hardness, and durability such as wear resistance and glossiness maintaining property at high levels, and includes a plurality of the antislip protrusions described below, can be obtained. The antislip structure can exhibit excellent antislip performance not only in a dry state in fine weather or the like but also in rainy weather or in cleaning operation using water, thereby enhancing safety in walking on a flooring material, in particular, a flooring material formed of ceramic tiles or a stone material.

In the curable composition (X), the curing catalyst used together with the above-described curable component is also called silanol condensation catalyst, and any curing catalyst commonly used in this technical field can be used as the curing catalyst. Examples of the curing catalyst include a metal-based catalyst such as an organic-tin-based compound and an organic-titanium-based compound, and a metal-based catalyst other than tin and titanium. The organic-tin-based compound is not particularly limited. Here, examples of the organic-tin-based compound include: tin carboxylates such as tin octylate, tin oleate, tin stearate, tin dioctylate, tin distearate, and tin dinaphthenate; dibutyltin dicarboxylates such as dibutyltin dilaurate and dibutyltin bis(alkylmaleate); alkoxide derivatives of dialkyltin, such as dibutyltin dimethoxide and dibutyltin diphenoxide; intramolecular coordination derivatives of dialkyltin, such as dibutyltin diacetylacetonate, dibutyltin acetoacetate, dibutyltin diethylhexanoate, dibutyltin dioctate, dibutyltin oxide, dibutyltin bisethoxysilicate, and dioctyltin oxide; a reaction mixture of dibutyltin oxide and an ester compound; a reaction mixture of dibutyltin oxide and a silicate compound; and derivatives of tetravalent dialkyltin oxide, such as oxy derivatives of dialkyltin oxide derivatives. Examples of the organic-titanium-based compound include tetra-n-butoxy titanate and tetraisopropoxytitanate. Examples of the metal-based catalyst other than tin and titanium include: calcium carboxylate containing, as a carboxylic acid component, octylic acid, oleic acid, naphthenic acid, stearic acid, or the like; and a metal carboxylate, such as calcium carboxylate, zirconium carboxylate, iron carboxylate, vanadium carboxylate, bismuth carboxylate, lead carboxylate, titanium carboxylate, and nickel carboxylate. Among them, the metal-based catalyst is preferable, and the organic-tin-based compound and the organic-titanium-based compound are more preferable, and the organic-tin-based compound is even more preferable. One kind of the curing catalyst may be used alone, or two or more kinds of the curing catalysts may be used in combination.

A content of the curing catalyst in the curable composition (X) is not particularly limited. However, the content of the curing catalyst is preferably 0.05 to 20 parts by weight, more preferably 0.1 to 10 parts by weight, and even more preferably 0.3 to 10 parts by weight with respect to 100 parts by weight of the curable component.

As described above, the curable composition (X) may contain a silane compound other than the crosslinkable-silyl-group-containing polymer and the alkoxy-group-containing-silicone oligomer as long as the physical properties of the cured product are not degraded.

A content of the silane compound in the curable composition (X) is not particularly limited. However, the content of the silane compound is preferably, 0.1 to 50 parts by weight, more preferably 2 to 45 parts by weight, and even more preferably 5 to 35 parts by weight with respect to 100 parts by weight of the curable component.

In the antislip treatment composition (hereinafter, may be referred to as "curable composition (Y)") containing thermosetting resin as the curable resin, silicone resin, epoxy resin, and urethane resin, for example, can be preferably used as the thermosetting resin. One kind of the thermosetting resin may be used alone or two or more kinds of the thermosetting resins may be used in combination. As the thermosetting resin contained in the curable resin (Y), thermosetting resin which is hardened at room temperature without heating process according to selection of a curing agent to be used in combination may also be used.

In the antislip treatment composition (hereinafter, may be referred to as "curable composition (Z)") containing photocurable resin as the curable resin, various curable resins which can be hardened by irradiation with rays of light such as ultraviolet rays can be used as the photocurable resin without any particular limitation. For example, photocurable acrylic resin and the like can be preferably used.

The thermosetting resin or the photocurable resin is used, similarly in the case where the moisture curable resin is used, whereby the contact angle of the antislip protrusion can be easily adjusted to be in a predetermined range. As a result, the antislip protrusion that has excellent antislip performance and anti-fouling performance, and can maintain the antislip performance for a long time period can be formed without degrading aesthetic appearance, design, easy-cleaning property, and the like of the floor surface. The curable resin that is in a liquid state at ordinary temperature and hardened after applied to the floor surface is preferably selected and used.

The antislip treatment composition that contains the curable resin such as the curable resins (X), (Y), and (Z) may contain a standard additive for resin as an optional component as long as the physical properties of the cured product are not degraded. Examples of the additive for resin include a filler, a plasticizer, a coloring agent, an organic solvent, an anti-aging agent, an ultraviolet absorber, a light stabilizer, an antioxidant, and a thixotropic agent. One or more kinds of the additives for resin may be used.

The curable composition (X) can be obtained by, for example, blending the above-described essential components (except for the curing catalyst), and, as appropriate, the above-described silane compound or additives for resin (except for the coloring agent), and depressurizing and degassing the obtained mixture, adding the curing catalyst to the degassed mixture, adding the coloring agent thereto as appropriate, and further blending the obtained product. The curable resin composition (Y), (Z), other than the above-described composition, containing the thermosetting resin or the photocurable resin may contain one or more kinds of the additives for resin.

The unhardened antislip treatment composition which has been thus obtained is transparent in general. If the antislip treatment composition is used as a material of the antislip protrusion, curable resin that is in a liquid state by itself, or a solution of the curable resin and an organic solvent is used. The viscosity thereof at 20° C. is preferably adjusted to be in a range of 30 mPa s to 200,000 mPa s as a value measured by a BH-type rotational viscometer (20 rpm).

The viscosity (20° C.) is preferably in a range of 50 mPa·s to 5000 mPa·s in consideration of operability for forming the antislip structure, and in consideration of allowing the antislip treatment composition to be merely partially deformed (for example, a portion near the top is deformed to have an almost curved face and/or deformed into an arc shape) and to substantially maintain a predetermined stereoscopic shape before fully hardened in the antislip structure manufacturing method described below. The viscosity of the antislip treatment composition can be adjusted according to, for example, selection of the anti slip treatment composition itself, or selection of a. kind or a content of a component contained in the anti slip treatment composition. Furthermore, the viscosity may be adjusted by an optional component or an additive for resin.

Next, an evaluation test for the tip portion structure of the application body will be described.

Application bodies having tip structures described below were produced as test samples.

Example 1

As shown in FIG. 7A, the application body 13 in which the rubber application tube 19 having a length of 5.0 mm and an outer diameter of 8.0 mm was attached to the tip portion of the stainless-steel support rod 18 having an acuminated tip portion and a diameter of 6.0 mm so that the tip portion of the support rod 18 protruded from the tip portion of the application tube 19 over 0.5 mm, was produced.

Example 2

As shown in FIG. 8F, the application body 13F that had the outer circumferential groove portion 25 formed as a helical groove on the outer circumferential portion of the support rod 18 F and had the partially spherical tip recess 20E over the entirety of the tip face so that the outer circumferential groove portion 25 was formed as a stainless-steel metric coarse screw thread having a nominal diameter of M6, was produced.

Example 3

An application body having a flat surface orthogonal to its length direction formed on the tip face, instead of the tip recess 20E of the application body 13F of example 2, was produced.

Example 4

As shown in FIG. 8E, the application body 13E that was formed as a metal rod made of an aluminium alloy with a diameter of 6 mm, and had the partially spherical tip recess 20E formed over the entirety of the tip face, was produced.

Example 5.1

As shown in FIG. 8G, the application body 13G that was formed as a metal rod made of an aluminium alloy with a diameter of 6 mm, had the flat surface 26 orthogonal to the length direction of the application body 13G on the tip face, and further had the annular outer circumferential groove portion 27 which was distant from the tip over a distance L2 of 1 mm with the groove width W1 of 1 mm and the depth of 0.5 mm, was produced Example 5.2

An application body was produced in the same manner as in example 5.1 except that the outer circumferential groove portion 27 of the application body 13G was formed so as to be distant from the tip over the distance L2 of 3 mm.

Example 5.3

An application body was produced in the same manner as in example 5.1 except that the outer circumferential groove portion 27 of the application body 13G was formed so as to be distant from the tip over the distance L2 of 5 mm.

Example 5.4

An application body was produced in the same manner as in example 5.1 except that the outer circumferential groove portion 27 of the application body 13G had the groove width W1 of 1.5 mm.

Example 5.5

An application body was produced in the same manner as in example 5.1 except that the outer circumferential groove portion 27 of the application body 13G had the groove width W1 of 2 mm.

Example 5.6

An application body was produced in the same manner as in example 5.1 except that two outer circumferential groove portions 27 each having the same structure as the outer circumferential groove portion 27 of the application body 13G were additionally provided in the application body 13G of example 5.1 so as to be distant from each other over the distance L3 of 1 mm as indicated by imaginary lines in FIG. SG so that the three outer circumferential groove portions 27 were provided in total.

Example 5.7

An application body was produced in the same manner as in example 5.1 except that four annular outer circumferential groove portions each having the same structure as the outer circumferential groove portion 27 of the application body 13G were additionally provided in the application body 13G of example 5.1 so as to be distant from each other over the distance L3 of 1 mm so that the five outer circumferential groove portions were provided in total.

Comparative Example 1

Figure 12A:
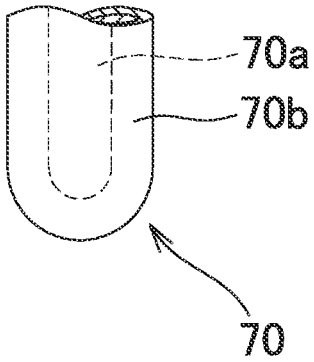
FIG. 12A is a front view of a tip portion of an application body according to comparative example 1.

As shown in FIG. 12A, an application body 70 having a diameter of 6 mm was produced by covering, with a rubber external member 70*b*, a tip portion of a rod-shaped member 70*a* that had a semispherical tip portion, had a diameter of 2.6 mm, and was made of an aluminium alloy.

Comparative Example 2

Figure 12B:
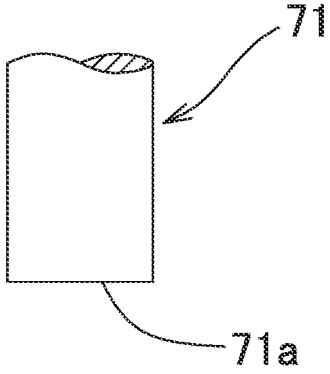
FIG. 12B is a front view of a tip portion of an application body according to comparative example 2.

As shown in FIG. 12B, an application body 71 that was formed as a metal rod made of an aluminium alloy with a diameter of 6 mm, and had a flat surface 71*a* orthogonal to the length direction of the application body 71 on the tip face, was produced.

The following evaluation tests were performed in a room at 25° C. In the evaluation tests, a silicone-based antislip treatment composition having a viscosity of 80 mPa s was used as coating liquid, and a liquid absorber made of urethane and placed in a tray was filled with the antislip treatment composition.

(Evaluation Test 1)

One application body of each of comparative examples 1, 2 and one application body 13, 13F of each of examples 1, 2 were used, and the tip portion of each application body was pressed against the liquid absorber to adhere the antislip treatment composition to the application body up to the height position that was distant from the tip of the application body over 7 mm. Thereafter, the tip portion of the application body was pressed against a to-be-coated surface for one second to form the coated portion 5A on the to-be-coated surface in one case. The tip portion of the application body was pressed against a to-be-coated surface for five seconds to form the coated portion 5A on the to-be-coated surface in another case. The diameter of the coated portion 5A was measured five times in each case. An average value of the diameters of the coated portions 5A was obtained. A rate of increase from the average value of the diameters in the case of the pressing time being one second to the average value of the diameters in the case of the pressing time being five seconds was obtained. The results are indicated in Table 1.

TABLE 1

| Specifications of tip portion of application body | | | | | Comp. | Comp |
|---|---|---|---|---|---|---|
| | Pressing time (sec) | n | Ex. 1 | Ex. 2 | Ex. 1 | Ex. 2 |
| Diameter (mm) of coated portion | 1 | 1 | 8.72 | 8.98 | 9.55 | 8.16 |
| | | 2 | 8.64 | 8.15 | 10.05 | 8.55 |
| | | 3 | 8.65 | 8.21 | 10.30 | 8.85 |
| | | 4 | 8.54 | 8.38 | 9.59 | 8.28 |
| | | 5 | 8.42 | 8.61 | 9.99 | 8.45 |
| | | Average | 8.59 | 8.47 | 9.90 | 8.46 |
| | 5 | 1 | 9.29 | 8.89 | 11.80 | 9.99 |
| | | 2 | 8.89 | 8.23 | 11.70 | 9.75 |
| | | 3 | 8.77 | 8.78 | 12.15 | 9.97 |
| | | 4 | 9.15 | 8.50 | 12.25 | 9.94 |
| | | 5 | 9.23 | 8.27 | 12.01 | 9.75 |
| | | Average | 9.07 | 8.53 | 11.98 | 9.88 |
| | Rate (%) of increase by increase of pressing time | | 5.5% | 0.8% | 21.1% | 16.8% |

Table 1 indicates that, in the application body 13 of example 1 having the tip recess 20 and the application body 13F of example 2 having the outer circumferential groove portion 25 as a screw groove on the outer circumferential portion and the recess 20E formed at the tip portion, variation in a diameter of the coated portion 5A due to difference in the pressing time was less than variation in the application body 70 of comparative example 1 which was covered with rubber and the application body 71 of comparative example 2 in which the tip had the flat surface. Furthermore, in the application body 13F of example 2 having the outer circumferential groove portion 25 as a screw groove on the outer circumferential portion, variation in a diameter of the coated portion 5A was less than variation in the application body 13 of example 1 having no screw groove on the outer circumferential portion. Therefore, the test results indicate that the application bodies 13, 13F of examples 1, 2 can reduce variation in a diameter of the coated portion 5A and can form the coated portion 5A having the uniform size, even if the pressing time slightly varies depending on an operator.

(Evaluation Test 2)

The application bodies of examples 2 to 4, examples 5.1 to 5.7, and comparative example 2 were used, and the tip portion of each application body was pressed against the liquid absorber to adhere the antislip treatment composition to the application body up to the height position that was distant from the tip of the application body over 7 mm. Thereafter, the tip portion of the application body was pressed against a to-be-coated surface for one second to form the coated portion 5A on the to-be-coated surface in one case. The tip portion of the application body was pressed against a to-be-coated surface for five seconds to form the coated portion 5A on the to-be-coated surface in another case. The diameter of the coated portion 5A and the weights of the application body before and after application of the unit coating liquid to the to-be-coated surface were measured five times in each case. An average value of amounts of the coating liquid adhered to the to-be-coated surfaces and an average value of the diameters of the coated portions 5A were obtained. A rate of increase from the average value of the amounts of the coating liquid adhered to the to-be-coated surfaces in the case of the pressing time being one second to the average value thereof in the case of the pressing time being five seconds, was obtained. A rate of increase from the average value of the diameters of the coated portions 5A in the case of the pressing time being one second to the average value thereof in the case of the pressing time being five seconds was obtained. The results are indicated in Tables 2 to 5.

TABLE 2

| | | | Examination as to presence or absence of tip recess | | | | | | | |
|---|---|---|---|---|---|---|---|---|---|---|
| Application body | | | M6 screw | | | | Aluminium rod having diameter of 6 mm | | | |
| Test sample | | | Ex. 2 | | Ex. 3 | | Ex. 4 | | Comp. Ex. 2 | |
| Specifications of tip | | | Recessed shape | | Flat | | Recessed shape | | Flat | |
| The number of grooves (groove number) | | | 5 | | 5 | | 0 | | 0 | |
| Groove position (mm) from tip | | | 0 | | 0 | | — | | — | |
| Groove width (mm) | | | 0.75 | | 0.75 | | — | | — | |
| Groove depth (mm) | | | 0.406 | | 0.406 | | — | | — | |
| Groove interval (mm) | | | 0.2 | | 0.2 | | — | | — | |
| Specifications of liquid absorber | | | Foamed urethane | | Foamed urethane | | Foamed urethane | | Foamed urethane | |
| Presence or absence of liquid dripping | | | No liquid dripping | | No liquid dripping | | No liquid dripping | | No liquid dripping | |
| Pressing time (sec) | | | 1 | 5 | 1 | 5 | 1 | 5 | 1 | 5 |
| Weight of application body | Before application (mg) | N = 1 | 74.0 | 64.7 | 63.6 | 78.5 | 42.2 | 40.2 | 34.1 | 40.5 |
| | | N = 2 | 60.7 | 65.4 | 77.7 | 68.8 | 38.4 | 37.4 | 42.5 | 38.6 |
| | | N = 3 | 69.1 | 56.6 | 76.2 | 72.7 | 36.6 | 40.5 | 35.8 | 41.3 |
| | | N = 4 | 59.2 | 53.3 | 64.8 | 64.8 | 41.2 | 43.9 | 42.6 | 42.2 |
| | | N = 5 | 58.3 | 65.8 | 66.6 | 67.7 | 39.7 | 42.8 | 40.1 | 44.8 |
| | | Average | 64.3 | 61.2 | 69.8 | 70.5 | 39.6 | 41.0 | 39.0 | 41.5 |

TABLE 2-continued

| Application body | | Examination as to presence or absence of tip recess | | | | | | | |
|---|---|---|---|---|---|---|---|---|---|
| | | M6 screw | | | | Aluminium rod having diameter of 6 mm | | | |
| After application (g) | N = 1 | 52.7 | 42.3 | 48.1 | 54.1 | 20.4 | 17.4 | 21.8 | 18.1 |
| | N = 2 | 43.2 | 41.6 | 55.8 | 44.9 | 19.1 | 18.8 | 21.9 | 17.3 |
| | N = 3 | 45.7 | 38.7 | 55.2 | 46.5 | 22.7 | 16.7 | 20.6 | 19.0 |
| | N = 4 | 43.3 | 36.2 | 47.1 | 44.9 | 23.5 | 18.6 | 22.6 | 20.1 |
| | N = 5 | 42.3 | 44.3 | 47.7 | 44.4 | 22.5 | 18.2 | 22.0 | 20.0 |
| | Average | 45.3 | 40.6 | 50.8 | 47.0 | 21.6 | 17.9 | 21.8 | 18.9 |
| Average amount (mg) adhered to floor surface | | 18.9 | 20.5 | 19.0 | 23.5 | 18.0 | 23.0 | 17.2 | 22.6 |
| Rate (%) of increase by increase of pressing time | | 8.6% | | 23.9% | | 28.0% | | 31.0% | |
| Diameter (mm) of coated portion | N = 1 | 8.98 | 8.89 | 8.05 | 8.68 | 8.31 | 9.69 | 8.16 | 9.99 |
| | N = 2 | 8.15 | 8.23 | 8.11 | 8.02 | 8.48 | 9.63 | 8.55 | 9.75 |
| | N = 3 | 8.21 | 8.78 | 8.52 | 8.85 | 8.76 | 9.14 | 8.85 | 9.97 |
| | N = 4 | 8.38 | 8.50 | 8.24 | 8.16 | 8.42 | 9.09 | 8.28 | 9.94 |
| | N = 5 | 8.61 | 8.27 | 8.22 | 8.42 | 8.41 | 9.84 | 8.45 | 9.75 |
| | Average | 8.47 | 8.53 | 8.23 | 8.43 | 8.48 | 9.48 | 8.46 | 9.88 |
| Rate (%) of increase by increase of pressing time | | 0.8% | | 2.4% | | 11.8% | | 16.8% | |

TABLE 3

| Application body | | | Examination as to groove position Aluminium rod having diameter of 6 mm | | | | | | | |
|---|---|---|---|---|---|---|---|---|---|---|
| Test sample | | | Comp. Ex. 2 | | Ex. 5.1 | | Ex. 5.2 | | Ex. 5.3 | |
| Specifications of tip | | | Flat | | Flat | | Fiat | | Flat | |
| The number of grooves (groove number) | | | 0 | | 1 | | 1 | | 1 | |
| Groove position (mm) from tip | | | — | | 1 | | 3 | | — | |
| Groove width (mm) | | | — | | 1 | | 1 | | 1 | |
| Groove depth (mm) | | | — | | 0.5 | | 0.5 | | 0.5 | |
| Groove interval (mm) | | | — | | — | | — | | — | |
| Specifications of liquid absorber | | | Foamed urethane | | Foamed urethane | | Foamed urethane | | Foamed urethane | |
| Presence or absence of liquid | | | No liquid dripping | | No liquid dripping | | No liquid dripping | | No liquid dripping | |
| Pressing time (sec) | | | 1 | 5 | 1 | 5 | 1 | 5 | 1 | 5 |
| Weight of application body | Before application (g) | N = 1 | 34.1 | 40.5 | 35.3 | 33.4 | 38.7 | 45.9 | 46.3 | 50.9 |
| | | N = 2 | 42.5 | 38.6 | 40.3 | 37.2 | 40.4 | 40.9 | 53.5 | 41.1 |
| | | N = 3 | 35.8 | 41.3 | 40.2 | 39.1 | 45.2 | 42.0 | 38.0 | 48.3 |
| | | N = 4 | 42.6 | 42.2 | 37.2 | 34.2 | 41.3 | 42.3 | 43.5 | 50.8 |
| | | N = 5 | 40.1 | 44.8 | 38.1 | 36.6 | 40.4 | 38.6 | 51.2 | 51.9 |
| | | Average | 39.0 | 41.5 | 38.2 | 36.1 | 41.2 | 41.9 | 46.5 | 48.6 |
| | After application (g) | N = 1 | 21.8 | 18.1 | 23.5 | 17.2 | 21.9 | 21.1 | 26.8 | 25.4 |
| | | N = 2 | 21.9 | 17.3 | 24.9 | 19.0 | 22.6 | 19.5 | 30.7 | 21.9 |
| | | N = 3 | 20.6 | 19.0 | 26.6 | 19.3 | 23.3 | 19.2 | 23.1 | 24.8 |
| | | N = 4 | 22.6 | 20.1 | 23.0 | 18.3 | 24.1 | 20.6 | 27.2 | 26.4 |
| | | N = 5 | 22.0 | 20.0 | 23.2 | 18.6 | 23.6 | 18.2 | 30.4 | 26.00 |
| | | Average | 21.8 | 18.9 | 24.2 | 18.5 | 23.1 | 19.7 | 27.6 | 24.9 |
| Average amount (mg) adhered to floor surface | | | 17.2 | 22.6 | 14.0 | 17.6 | 18.1 | 22.2 | 18.9 | 23.7 |
| Rate (%) of increase by increase of pressing time | | | 31.0% | | 26.0% | | 22.8% | | 25.7% | |
| Diameter (mm) of coated portion | | N = 1 | 8.16 | 9.99 | 8.21 | 8.11 | 8.61 | 9.51 | 8.94 | 9.59 |
| | | N = 2 | 8.55 | 9.75 | 9.08 | 9.34 | 8.98 | 9.09 | 9.10 | 9.30 |
| | | N = 3 | 8.85 | 9.97 | 8.73 | 9.45 | 9.16 | 9.21 | 8.88 | 9.43 |
| | | N = 4 | 8.28 | 9.94 | 7.49 | 9.47 | 8.54 | 9.33 | 8.97 | 9.64 |
| | | N = 5 | 8.45 | 9.75 | 8.91 | 9.28 | 8.73 | 9.30 | 8.92 | 9.67 |
| | | Average | 8.46 | 9.88 | 8.48 | 9.13 | 8.80 | 9.29 | 8.96 | 9.53 |
| Rate (%) of increase by increase of pressing time | | | 16.8% | | 7.6% | | 5.5% | | 6.3% | |

TABLE 4

| Application body | | | Examination as to groove width Aluminium rod having diameter of 6 ram | | | | | | | |
|---|---|---|---|---|---|---|---|---|---|---|
| Test sample | | | Comp. Ex. 2 | | Ex. 5.1 | | Ex. 5.4 | | Ex. 5.5 | |
| Specifications of tip | | | Flat | | Flat | | Flat | | Flat | |
| The number of grooves (groove number) | | | 0 | | 1 | | 1 | | 1 | |
| Groove position (mm) from tip | | | — | | 1 | | 1 | | 1 | |
| Groove width (mm) | | | — | | 1 | | 1.5 | | 2 | |
| Groove depth (mm) | | | — | | 0.5 | | 0.5 | | 0.5 | |
| Groove interval (mm) | | | — | | — | | — | | — | |
| Specifications of liquid absorber | | | Foamed urethane | | Foamed urethane | | Foamed urethane | | Foamed urethane | |
| Presence or absence of liquid | | | No liquid dripping | | No liquid dripping | | No liquid dripping | | No liquid dripping | |
| Prossing time (sec) | | | 1 | 5 | 1 | 5 | 1 | 5 | 1 | 5 |
| Weight of application body | Before application (g) | N = 1 | 34.1 | 40.5 | 35.3 | 33.4 | 50.7 | 50.1 | 54.7 | 48.3 |
| | | N = 2 | 42.5 | 38.6 | 40.3 | 37.2 | 45.3 | 48.5 | 50.6 | 50.9 |
| | | N = 3 | 35.8 | 41.3 | 40.2 | 39.1 | 47.7 | 45.3 | 44.3 | 45.3 |
| | | N = 4 | 42.6 | 42.2 | 37.2 | 34.2 | 42.2 | 48.0 | 48.9 | 44.5 |
| | | N = 5 | 40.1 | 44.8 | 38.1 | 36.6 | 45.7 | 46.1 | 49.3 | 46.2 |
| | | Average | 39.0 | 41.5 | 38.2 | 36.1 | 46.3 | 47.6 | 49.6 | 47.0 |
| | After application (g) | N = 1 | 21.8 | 18.1 | 23.5 | 17.2 | 31.5 | 26.7 | 35.6 | 28.2 |
| | | N = 2 | 21.9 | 17.3 | 24.9 | 19.0 | 27.8 | 25.6 | 34.3 | 29 |
| | | N = 3 | 20.6 | 19.0 | 26.6 | 19.3 | 30.0 | 22.9 | 30.9 | 26.9 |
| | | N = 4 | 22.6 | 20.1 | 23.0 | 18.3 | 26.5 | 27.6 | 33.4 | 25.3 |
| | | N = 5 | 22.0 | 20.0 | 23.2 | 18.6 | 27.6 | 27.0 | 32.2 | 27.9 |
| | | Average | 21.8 | 18.9 | 24.2 | 18.5 | 28.7 | 26.0 | 33.3 | 27.5 |
| Average amount (mg) adhered to floor surface | | | 17.2 | 22.6 | 14.0 | 17.6 | 17.6 | 21.6 | 16.3 | 19.6 |
| Rate (%) of increase by increase of pressing time | | | 31.0% | | 26.0% | | 22.7% | | 20.3% | |
| Diameter (mm) of coated portion | | N = 1 | 8.16 | 9.99 | 8.21 | 8.11 | 8.60 | 9.54 | 8.98 | 8.95 |
| | | N = 2 | 8.55 | 9.75 | 9.08 | 9.34 | 8.68 | 8.97 | 8.50 | 9.14 |
| | | N = 3 | 8.85 | 9.97 | 8.73 | 9.45 | 8.68 | 8.79 | 8.98 | 9.02 |
| | | N = 4 | 8.28 | 9.94 | 7.49 | 9.47 | 8.62 | 8.75 | 8.63 | 8.91 |
| | | N = 5 | 8.45 | 9.75 | 8.91 | 9.28 | 8.67 | 9.20 | 9.19 | 8.75 |
| | | Average | 8.46 | 9.88 | 8.48 | 9.13 | 8.65 | 9.05 | 8.86 | 8.95 |
| Rate (%) of increase by increase of pressing time | | | 16.8% | | 7.6% | | 4.6% | | 1.1% | |

TABLE 5

| Application body | | | Examination as to the number of grooves Aluminium rod having diameter of 6 mm | | | | | | | |
|---|---|---|---|---|---|---|---|---|---|---|
| Test sample No. | | | Comp. Ex. 2 | | Ex. 5.1 | | Ex. 5.6 | | Ex. 5.7 | |
| Specifications of tip | | | Flat | | Flat | | Flat | | Flat | |
| The number of grooves (groove number) | | | 0 | | 1 | | 3 | | 5 | |
| Groove position (mm) from tip | | | — | | — | | 1 | | 1 | |
| Groove width (mm) | | | — | | 1 | | 1 | | | |
| Groove depth (mm) | | | — | | 0.5 | | 0.5 | | 0.5 | |
| Groove interval (mm) | | | — | | — | | 1 | | | |
| Specifications of liquid absorber | | | Foamed urethane | | Foamed urethane | | Foamed urethane | | Foamed urethane | |
| Presence or absence of liquid dripping | | | No liquid dripping | | No liquid dripping | | No liquid dripping | | No liquid dripping | |
| Pressing time (sec) | | | 1 | 5 | 1 | 5 | 1 | 5 | 1 | 5 |
| Weight of application body | Before application (g) | N = 1 | 34.1 | 40.5 | 35.3 | 33.4 | 55.3 | 58.4 | 58.4 | 48.2 |
| | | N = 2 | 42.5 | 38.6 | 40.3 | 37.2 | 50.0 | 57.0 | 48.2 | 41.8 |
| | | N = 3 | 35.8 | 41.3 | 40.2 | 39.1 | 58.4 | 54.0 | 54.1 | 50.2 |
| | | N = 4 | 42.6 | 42.2 | 37.2 | 34.2 | 55.1 | 55.1 | 48.8 | 51.2 |
| | | N = 5 | 40.1 | 44.8 | 38.1 | 36.6 | 54.2 | 44.7 | 47.7 | 55.7 |
| | | Average | 39.0 | 41.5 | 38.2 | 36.1 | 54.6 | 53.8 | 51.4 | 49.4 |
| | After application (g) | N = 1 | 21.8 | 18.1 | 23.5 | 17.2 | 37.0 | 34.2 | 37.8 | 30.7 |
| | | N = 2 | 21.9 | 17.3 | 24.9 | 19.0 | 34.8 | 35.2 | 34.1 | 26.9 |
| | | N = 3 | 20.6 | 19.0 | 26.6 | 19.3 | 37.8 | 33.8 | 36.3 | 31.4 |
| | | N = 4 | 22.6 | 20.1 | 23.0 | 18.3 | 37.7 | 33.7 | 33.9 | 31.2 |
| | | N = 5 | 22.0 | 20.0 | 23.2 | 18.6 | 39.9 | 31.2 | 33.8 | 31.8 |
| | | Average | 21.8 | 18.9 | 24.2 | 18.5 | 37.4 | 33.6 | 35.2 | 30.4 |
| Average amount (mg) adhered to floor surface | | | 17.2 | 21.6 | 14.0 | 17.6 | 17.2 | 20.1 | 16.3 | 19.0 |
| Rate (%) of increase by increase of pressing time | | | 31.3% | | 26.0% | | 17.8% | | 17.0% | |

TABLE 5-continued

| Application body | | Examination as to the number of grooves Aluminium rod having diameter of 6 mm | | | | | | | |
|---|---|---|---|---|---|---|---|---|---|
| Diameter (mm) of coated portion | N = 1 | 8.16 | 9.99 | 8.21 | 8.11 | 8.62 | 9.01 | 8.78 | 9.36 |
| | N = 2 | 8.55 | 9.75 | 9.08 | 9.34 | 8.54 | 8.93 | 8.61 | 8.80 |
| | N = 3 | 8.85 | 9.97 | 8.73 | 9.45 | 8.75 | 8.67 | 9.06 | 9.24 |
| | N = 4 | 8.28 | 9.94 | 7.49 | 9.47 | 8.24 | 9.05 | 8.43 | 9.19 |
| | N = 5 | 8.45 | 9.75 | 8.91 | 9.28 | 8.32 | 9.04 | 8.74 | 8.34 |
| | Average | 8.46 | 9.88 | 8.48 | 9.13 | 8.49 | 8.94 | 8.72 | 8.99 |
| Rate (%) of increase by increase of pressing time | | 16.8% | | 7.6% | | 5.7% | | 3.0% | |

According to Table 2, in the application body 13F of example 2 in which the outer circumferential groove portion 25 was formed as a screw groove on the outer circumferential surface of the tip portion and the tip recess 20E was formed in the tip face, variation in an amount of the adhered coating liquid and variation in a diameter of the coated portion 5A were less than those in examples 3, 4 and comparative example 2. Furthermore, according to the test results, even in a case where the tip face was formed as the flat surface as in example 3, variation in an amount of adhered coating liquid and variation in a diameter of the coated portion 5A were reduced by forming the outer circumferential groove portion 25 as a screw groove on the outer circumferential surface of the tip portion. Furthermore, according to the test results, also in a case where the outer circumferential groove portion 25 was not formed as a screw groove on the outer circumferential surface of the tip portion as in example 4, variation in an amount of the adhered coating liquid and variation in a diameter of the coated portion 5A were reduced by forming the tip recess 20E in the tip face. Moreover, according to the test results, since example 3 is more excellent than example 4, the outer circumferential groove portion 25 made a greater contribution to reduction of variation than the tip recess 20E.

As indicated in Table 3 to Table 5, also in examples 5.1 to 5.7 in which the outer circumferential groove portion 27 was formed as an annular groove instead of the outer circumferential groove portion 25 formed as a screw groove, variation in an amount of the attached coating liquid and variation in a diameter of the coated portion 5A were reduced as compared with comparative example 2 in which the outer circumferential groove portion 27 was not provided.

If the outer circumferential groove portion 27 is formed as an annular groove, the distance L2 from the tip portion of the application body to the outer circumferential groove portion 27 is preferably 1 mm or more and 5 mm or less as indicated in Table 3. As indicated in Table 4, the greater the groove width W1 of the outer circumferential groove portion 27 is, the less the variation is. Therefore, the groove width W1 is preferably 1 mm or more. As indicated in Table 5, although the number of the outer circumferential groove portions 27 may be one, the number of the outer circumferential groove portions 27 is preferably maximized.

While the invention has been described with reference to the embodiments, the invention is not limited to the above-described embodiments at all, and it should be understood that the configuration thereof may be modified without departing from the gist of the invention.

DESCRIPTION OF THE REFERENCE CHARACTERS

1: application tool
2: to-be-coated surface
2*a*: protrusion
3: liquid absorber
4: application tray
5: unit coating liquid
5A: coated portion
10: application tool body
11: casing
11*a*: upper wall portion
11*b*: side wall portion
12: support plate
12*a*: flat plate portion
12*b*: mounting portion
12*c*: upper through hole
12*d*: upper guide hole
13: application body
14: first urging member
15: guide rod
15*a*: bolt head portion
15*b*: screw portion
16: second urging member
17: guide plate
17*a*: lower through hole
17*b*: lower guide hole
18: support rod
18*a*: protrusion
18*b*: screw portion
19: application tube
20: tip recess
21: regulation nut
22: nut member
23: nut member
30: operation portion
31: operation rod
32: base plate
33: connecting portion
13A: application body
18A: support rod
18Aa: protrusion
20A: tip recess
13B: application body
18B: support rod
18Ba: end face
20B: tip recess
13C: application body
18C: support rod
18Ca: tubular portion
18Cb: protrusion
20C: tip recess
13D: application body
18D: support rod
18Da: tubular portion
20D: tip recess
13E: application body
18E: support rod

20E: tip recess
13F: application body
18F: support rod
25: outer circumferential groove portion
13G: application body
18G: support rod
26: flat surface
27: outer circumferential groove portion
40: application tool body
41: base member
13H: application body
18H: support rod
50: application tool
51: application tool body
52: handle member
53: pressing plate
54: upper face plate
55: cushion member
56: support plate
57: guide member
58: second elastic member
59: guide member
60: lower frame
61: application unit
70: application body
70*a*: rod-shaped member
70*b*: external member
71: application body
71*a*: flat surface
50J: application tool
56J: support plate
65: guide plate
66: through hole
67: attaching tool
50K: application tool
55K: unit cushion member
56K: unit support plate
68: cut portion

The invention claimed is:

1. An application tool comprising:

a support plate;

a plurality of application bodies disposed at the support plate so as to protrude, and a guide member, wherein each of the plurality of application bodies has, at a tip portion thereof, a holding recess capable of holding coating wherein the plurality of application bodies are disposed at the support plate so as to be movable in an up-down direction, and urged toward lower limit positions constantly and separately, wherein the guide member is disposed so that a lower end portion of the guide member is movable in the up-down direction between an upper position and a lower position below the lower end portion of a corresponding one of the application bodies, and an urging member for constantly urging the guide member toward the lower position thereof is provided, and wherein the application tool body is aligned with and placed on a to-be-coated surface, and the application tool body is pressed downward to allow the guide member to be moved relatively upward against an urging force of the urging member, thereby allowing the application body to be moved downward, so that the coating liquid held at the application body is applied to the to-be-coated surface, while the guide member remains seated onto the to-be-coated surface.

2. The application tool according to claim 1, wherein a tip recess having an opening at a tip face of the application body is formed as the holding recess.

3. The application tool according to claim 2, wherein a protrusion protruding outward of the opening of the tip recess is disposed at a bottom of the tip recess.

4. The application tool according to claim 2, wherein each of the plurality of application bodies includes a support rod disposed at the support plate so as to protrude, and an application tube disposed on an outer side of a tip portion of the support rod, and the tip recess is formed in a tip portion of the application tube.

5. The application tool according to claim 4, wherein the tip portion of the support rod has a protrusion formed as an acuminated portion that protrudes outward of the opening of the tip recess.

6. The application tool according to claim 1, wherein an annular or a helical outer circumferential groove portion having an opening at an outer circumferential surface of the tip portion of the application body is disposed as the holding recess.

7. The application tool according to claim 1, wherein the support plate has a flat-plate shape.

8. The application tool according to claim 1, wherein the guide member has a guide plate, disposed parallel to the support plate, for guiding a mid-portion of each of the plurality of application bodies so that the mid-portion of the application body is movable in a length direction of the application body.

9. The application tool according to claim 1, wherein the coating liquid contains an antislip treatment composition.

* * * * *